US005864798A

United States Patent [19]

Miseki et al.

[11] Patent Number: 5,864,798

[45] Date of Patent: Jan. 26, 1999

[54] METHOD AND APPARATUS FOR ADJUSTING A SPECTRUM SHAPE OF A SPEECH SIGNAL

[75] Inventors: Kimio Miseki, Kawasaki; Masahiro Oshikiri, Urayasu; Akinobu Yamashita, Tokyo; Masami Akamine, Yokosuka; Tadashi Amada, Kawasaki, all of Japan

[73] Assignee: Kabushiki Kaisha Toshiba, Kawasaki, Japan

[21] Appl. No.: 714,260

[22] Filed: Sep. 17, 1996

[30] Foreign Application Priority Data

| | | | |
|---|---|---|---|
| Sep. 18, 1995 | [JP] | Japan | 7-238878 |
| Sep. 22, 1995 | [JP] | Japan | 7-244555 |
| Nov. 10, 1995 | [JP] | Japan | 7-292491 |

[51] Int. Cl.[6] ..... G10L 9/00

[52] U.S. Cl. ..... 704/225; 104/224; 104/217; 104/219

[58] Field of Search ..... 704/225, 224, 704/217, 219

[56] References Cited

U.S. PATENT DOCUMENTS 5,235,669 8/1993 Ordentlich et al. ..... 704/225

OTHER PUBLICATIONS

IEEE Transactions on Speech and Audo Processing, vol. 3, No. 1, pp. 59–71, Jan. 1995, Juin–Hwey Chen, et al., "Adaptive Postfiltering For Quality Enhancement Of Coded Speech".

Pro. IEEE ICASSP, pp. 155–1158, Apr. 1988, W.B. Kleijn, et al., "Improved Speech Quality And Efficient Vector Quantization In Selp".

*Primary Examiner*—David D. Knepper
*Assistant Examiner*—Susan Wieland
*Attorney, Agent, or Firm*—Oblon, Spivak, McClelland, Maier & Neustadt, P.C.

[57] ABSTRACT

Adjusting the shape of a spectrum of a speech signal includes the steps of using a first filter with pole-zero transfer function A(z)/B(z) for subjecting a speech signal to a spectrum envelop emphasis and a second filter cascade-connected with the first filter, for compensating for a spectral tilt due to the first filter, independently deriving two filter coefficients used in the second filter for compensating for the spectral tilt from the pole-zero transfer function, and compensating for the spectral tilt corresponding to the pole-zero transfer function according to the derived filter coefficients.

22 Claims, 16 Drawing Sheets

METHOD AND APPARATUS FOR ADJUSTING A SPECTRUM SHAPE OF A SPEECH SIGNAL

BACKGROUND OF THE INVENTION

1. Field of the Invention

This invention relates to a method and apparatus for adjusting the spectrum shape of a speech signal to enhance the speech quality of the decoded speech and synthesis speech.

2. Description of the Related Art

In a speech encoding/decoding system for encoding a speech signal at a low bit rate, supplying the coded data to a transmission system or storage system and then decoding the coded data, a post filter is disposed on the final stage of the speech decoder in many cases in order to enhance the subjective speech quality of the speech signal decoded and reconstructed on the decoding side.

In the conventional post-filtering speech decoding apparatus having a post filter incorporated therein, various parameters contained in coded data are decoded by a parameter decoder and a speech signal is reconstructed by a speech signal reconstructor based on the decoded parameter information.

The post filter is arranged on the succeeding stage of the decoder having the parameter decoder and the speech signal reconstructor. The pitch filter is constructed by cascade-connecting a pitch harmonics emphasis filter, spectrum envelop emphasis filter, high-pass filter and gain controller.

The function of the post filter is roughly divided into emphasis of pitch harmonics, emphasis of spectrum envelop, emphasis of high-pass component and filter gain control. Among the above factors, the pitch harmonics and spectrum envelop are important factors for determining the tone and phoneme of a speech and a clear speech which sounds free from noise can be created by emphasizing these factors. The filter gain control is necessary to keep constant the level of the speech signal at the time of input to and output from the post filter.

Emphasis of high-pass component is effected to compensate for the insufficient quality of the high-pass component of the speech caused by the characteristic of the post filter and coding such as "muffled speech sound quality" and "less-audible speech sound quality". Particularly, the filter used for emphasis of spectrum envelop tends to have an unnecessary spectral tilt (tilt of low-pass emphasis on average) in many cases and the emphasis of high-pass component is used to compensate for the above tendency.

In the prior art, as the high-pass emphasis filter, for example, a filter having a fixed transfer function of $C(z)=1-\mu z^{-1}$ ($\mu$ is a fixed value of approximately 0.4) is used. If the above high-pass filter is used, the "muffled speech sound" can be improved and the subjective sound quality can be enhanced to some extent. However, for example, a speech in an interval such as a consonant interval which does not require the high-pass emphasis will be subjected to excessive high-pass emphasis to produce abnormal sound in the high frequency domain, and as a result, sufficient improvement of sound quality cannot be attained.

That is, by carefully listening to and analyzing the muffled speech sound, it is understood that the speech is not always muffled and the speech sounds muffled as a whole since the time length of the speech interval in which the high frequency sound is not fully produced is long. The degree to which the high frequency sound is not adequately produced is different for each speech interval. Therefore, if the high-pass filter having the fixed transfer function is used, the interval in which the high frequency sound is adequately produced is also subjected to high-pass emphasis, thereby deteriorating the sound quality.

As another prior art, a method for subjecting the transfer function F(z) of the spectrum envelop emphasis filter to predictive analysis and adequately changing the value of a parameter $\mu$ in the transfer function C(z) of the high-pass filter based on the result of predictive analysis is known. However, in this method, since the transfer function F(z) of the spectrum envelop emphasis filter is represented by that of a pole-zero filter whose order is generally high, the calculation for deriving the parameter $\mu$ becomes extremely complex.

As described above, the conventional post filter using the high-pass filter with a fixed transfer function has a problem that a speech in an interval which does not require the high-pass emphasis will be subjected to excessive high-pass emphasis to produce abnormal sound in the high frequency domain, and the post filter for predicting the transfer function of the spectrum envelop emphasis filter and adequately changing the transfer function of the high-pass filter based on the result of prediction has a problem that the amount of calculations becomes extremely large.

SUMMARY OF THE INVENTION

An object of this invention is to provide a method and apparatus for adjusting the shape of spectrum of a speech signal which can stably improve the speech quality of decoded speech and synthesis speech with small amount of calculations.

Another object of this invention is to provide a method for adjusting the shape of spectrum of a speech signal which can prevent degradation in the speech quality at the time of gain control effected when the spectrum shape of the speech signal is adjusted.

According to this invention, there is provided a method for adjusting the shape of spectrum of a speech signal, comprising the steps of cascade-connecting a first filter with pole-zero transfer function for subjecting a speech signal to a spectrum envelop emphasis and a second filter for compensating for a spectral tilt due to the first filter; independently deriving two filter coefficients used in the second filter from the pole-zero transfer function to compensate for the spectral tilt; and compensating for a spectral tilt corresponding to the pole-zero transfer function according to the derived filter coefficients.

According to this invention, there is provided an apparatus for adjusting the shape of spectrum of a speech signal, comprising a first filter with pole-zero transfer function for subjecting a speech signal to a spectrum envelop emphasis; and a second filter for compensating for a spectral tilt due to the first filter, the second filter including a calculator for independently deriving two filter coefficients from the pole-zero transfer function input from the first filter and a filter section for subjecting the speech signal output from the first filter to a filtering process according to the derived filter coefficients and compensating for a spectral tilt corresponding to the pole-zero transfer function.

According to the invention, there is provided an apparatus for adjusting a shape of spectrum of a speech signal, comprising: a synthesis filter analyzer for analyzing an input speech signal to output synthesis filter data; a filter data calculator for calculating weighting filter data and pole-zero transfer function on the basis of the synthesis filter data from the synthesis filter analyzer; and a weighting filter for filtering the input speech signal on the basis of the weighting filter data and the pole-zero transfer function, the weighting filter including a first filter having pole-zero transfer function and a second filter having pole-zero transfer function for compensating for a spectral tilt due to the first filter.

According to the present invention, there is provided a method for adjusting a shape of spectrum of a speech signal, comprising the steps of preparing a first filter having pole-zero transfer function represented by A(z)/B(z) and a second filter for compensating for characteristics of the first filter; and deriving two parameters used in the second filter from the transfer functions A(z) and B(z) individually.

According to the present invention, there is provided a method for adjusting a shape of spectrum of a speech signal, comprising the steps of preparing a first filter having pole-zero transfer function represented by A(z)/B(z) and a second filter for compensating for characteristics of the first filter, the second filter having transfer function represented by $(1-\mu_z z^{-1})/(1-\mu_p z^{-1})$, where $\mu_z$ and $\mu_p$ are respective filter coefficients whose absolute values are smaller than 1; and filtering the speech signal by means of the first and second filters.

According to the present invention, there is provided a method for adjusting a shape of spectrum of a speech signal by subjecting a predetermined filter process to the speech signal, comprising the step of determining the sign of the gain to be multiplied by the speech signal and replacing the gain by a value which is not negative and given by a preset method if the gain is negative when the gain which is multiplied by the speech signal to compensate for a variation in the power of the speech signal caused by compensation for the spectral tilt is controlled.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
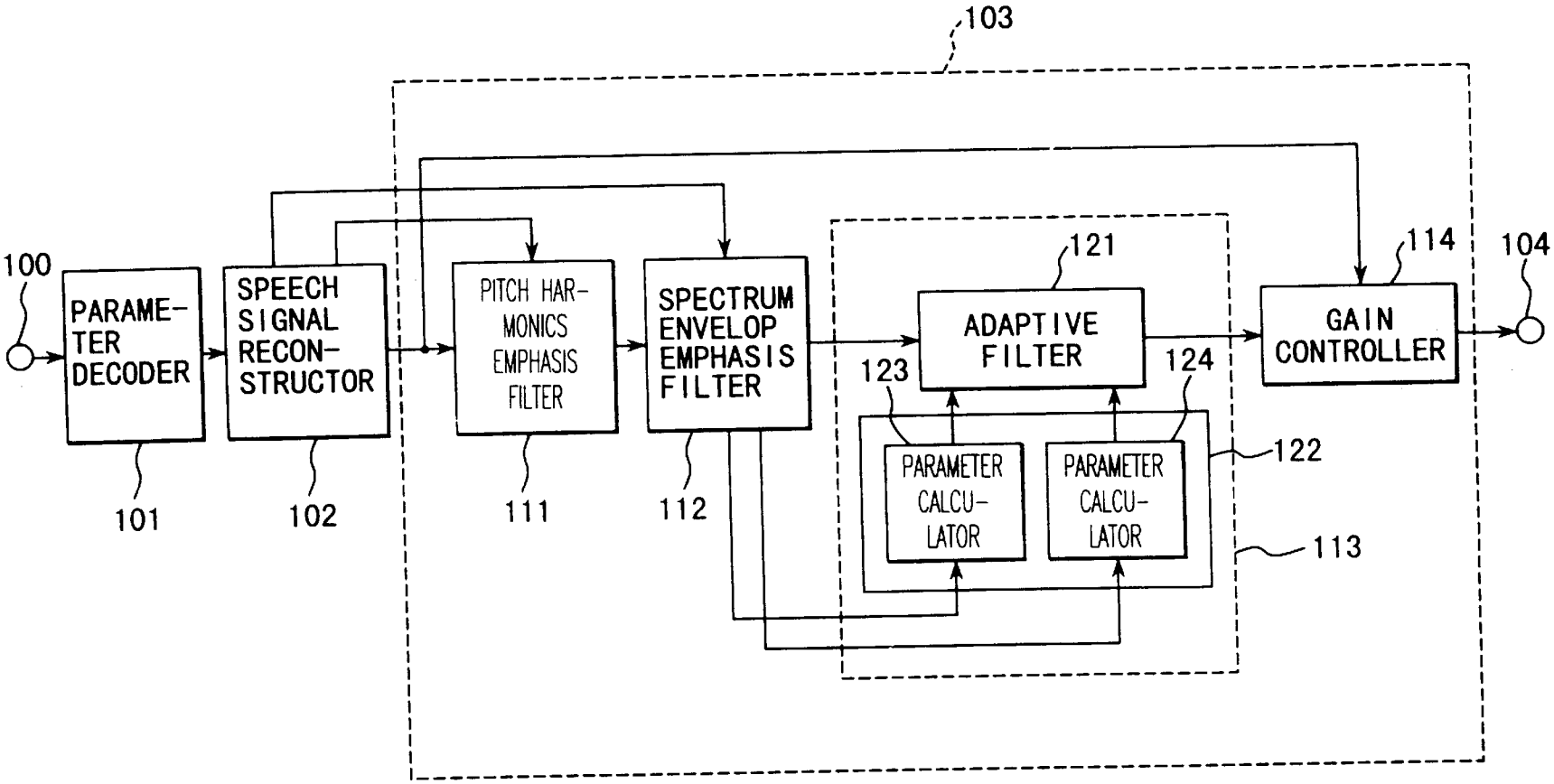
FIG. 1 is a block diagram of a speech decoding apparatus having a post filter incorporated therein according to first to third embodiments.

A speech decoding apparatus having a post filter incorporated therein according to a first embodiment of this invention is explained with reference to FIG. 1. The speech decoding apparatus includes a parameter decoder 101, speech signal reconstructor 102 and post filter 103.

Coded data transmitted from a speech coding apparatus on the transmission side is input to an input terminal 100. The coded data is input to the parameter decoder 101 and parameter information items such as pitch vector, stochastic vector, gain and LPC coefficient used in the speech signal reconstructor 102 are decoded. The speech signal reconstructor 102 reconstructs the speech signal based on the input parameter information.

As one example of the speech signal reconstructor 102, a speech signal reconstructor of CELP (Code Excited Linear Prediction) scheme can be given. In the speech signal reconstructor of this scheme, an excitation signal for an LPC synthesis filter is created by multiplying the reconstructed pitch vector and stochastic vector by the reconstructed gain and then combining them and a speech signal is reconstructed by passing the excitation signal through the LPC synthesis filter.

The post filter 103 is connected at the final stage of the speech decoding apparatus and used for enhancing the subjective speech quality of the reconstructed speech signal. The post filter in this embodiment is constructed by cascade-connecting a pitch harmonics emphasis filter 111, spectrum envelop emphasis filter 112, compensation filter 113 and gain controller 114. The compensation filter 113 includes an adaptive filter 121 and a filter coefficient calculator 122 for calculating the filter coefficient thereof, and the filter coefficient calculator 122 includes a first parameter calculator 123 and a second parameter calculator 124. The gain controller 114 smoothly controls the gain so that the speech signal processed by the post filter 113 may have substantially the same power as the speech signal obtained before the processing and outputs the speech signal after the gain control process to a speech signal output terminal 104.

Next, the post filter 103 is explained in more detail.

The pitch harmonics emphasis filter 111 is a filter used for emphasizing the repetition of the pitch period of the speech signal. As the design method of the pitch harmonics emphasis filter 111, various design methods using the pitch period and pitch gain as parameters are considered, but $P(z)=1/(1-\epsilon\beta z^{-T})$ can be used as one example of the transfer function thereof. T is the pitch period, $\beta$ is the pitch gain and $\epsilon$ is a parameter for adjusting the degree of pitch emphasis, and these parameters are set in a relation of $0<\epsilon\beta<1$.

The spectrum envelop emphasis filter 112 is used for emphasizing the shape of the spectrum envelop of the speech signal and the transfer function thereof is set to F(z). In the CELP scheme, a method for emphasizing the spectrum envelop by using a pole-zero filter having the transfer function F(z) indicated by the following equation as the spectrum envelop emphasis filter 112 is generally used.

$$F(z)=A(z)/B(z) \tag{1}$$

where $A(z)=1/H(z/\gamma_1)$, $B(z)=1/H(z/\gamma_2)$ $(0<\gamma_1<\gamma_2)$, and H(z) is a transfer function representing the spectrum envelop of the speech signal.

Since the irregularity of the spectrum envelop can be emphasized if the above spectrum envelop emphasis filter 112 is used, the speech signal after passing through the post filter 101 is perceptually sensed to have reduced noise. However, with this construction, various spectrum tilts will be added according to a variation in the transfer function F(z) determined for each speech.

That is, the transfer function F(z) of the spectrum envelop emphasis filter 112 constructed by the pole-zero filter may have a low-pass emphasis spectral tilt of non-negligible degree when viewing the whole spectra in some cases. A high-pass filter of transfer function of C(z) used in the conventional post filter has a function of compensating for the unnecessary low-pass emphasis spectral tilt of the spectrum envelop emphasis filter in addition to a function of raising the high frequency component which is degraded in the coding process.

However, since the transfer function F(z) of the spectrum envelop emphasis filter 112 varies according to the characteristic of the spectrum envelop of the speech signal to be processed, the spectral tilt thereof varies with time. That is, F(z) may have a low-pass emphasis characteristic at a certain instant, but F(z) may have a high-pass emphasis characteristic at another instant (for example, a speech interval of consonant). In this case, if the high-pass filter of transfer function C(z) is used as in the prior art, the high frequency component of the speech is excessively emphasized to produce an abnormal sound.

On the other hand, in this embodiment, the spectral tilt caused by using the spectrum envelop emphasis filter 112 with the transfer function F(z) expressed by the equation (1) is compensated for by the compensation filter 113 constructed by the adaptive filter 121 and filter coefficient calculator 122 and the adjustment can be made to give the brightness characteristic to the speech quality if necessary. The parameter calculators 123 and 124 of the filter coefficient calculator 122 receive filter coefficients of zero and pole filter transfer functions A(z) and B(z) and calculate two parameters used in the adaptive filter 121.

Next, the compensation filter 113 is explained in detail.

The transfer function F(z) of the spectrum envelop emphasis filter 112 indicated in the equation (1) is F(z)=A(z)/B(z) and can be expressed in a form divided into pole and zero filters. In this case, A(z) and B(z) are expressed as follows.

$$A(z)=\Sigma a_i z^{-i}, a_0=1, (i=0 \text{ to } 10) \tag{2}$$

$$B(z)=\Sigma b_i z^{-i}, b_0=1, (i=0 \text{ to } 10) \tag{3}$$

In the filter coefficient calculator 122, the parameter calculator 123 deals with the filter coefficients of A(z) as the impulse response of A(z), derives a first parameter $\rho_A$ corresponding to the first-order normalized autocorrelation coefficient of the impulse response, and supplies the first parameter to the adaptive filter 121. Likewise, the parameter calculator 124 deals with the filter coefficients of B(z) as the impulse response of B(z), derives a second parameter $\rho_B$ corresponding to the first-order normalized autocorrelation coefficient of the impulse response, and supplies the second parameter to the adaptive filter 121. The parameters $\rho_A$ and $\rho_B$ can be defined by the following equations.

$$\rho_A=\Sigma a_i a_{i-1})/(\Sigma a_i) \tag{4}$$

$$\rho_B=\Sigma b_i b_{i-1})/(\Sigma b_i) \tag{5}$$

The values of the parameters $\rho_A$ and $\rho_B$ are the first-order prediction coefficients for the impulse responses of the filters of the transfer functions A(z) and B(z), respectively.

a(z) and b(z) are derived by using the parameters $\rho_A$ and $\rho_B$ according to the following equations (6) and (7).

$$a(z)=1-\tau_A(\rho_A)z^{-1} \tag{6}$$

$$b(z)=1-\tau_B(\rho_B)z^{-1} \tag{7}$$

The transfer function of the adaptive filter 121 is set by using a(z) and b(z) according to the following equation (8).

$$D(z)=a(z)/b(z) \tag{8}$$

where $\tau_A(\ )$ and $\tau_B(\ )$ are functions for adjusting the values of the parameters $\rho_A$ and $\rho_B$. Thus, the spectral tilt by the spectrum envelop emphasis filter 112 of transfer function F(z) can be effectively compensated for by the adaptive filter 121 of transfer function D(z).

The transfer function of the equation (8) becomes the first-order pole-zero transfer function expressed by $(1-\mu_z z^{-1})/(1-\mu_p z^{-1})$. In this case, $\mu_z$, $\mu_p$ are filter coefficients whose absolute values are smaller than 1 and which are independent from each other, and in this example, $\mu_z=\tau_A(\rho_A)$ and $\mu_p=\tau_B(\rho_B)$. In other words, the transfer functions $\mu_z$, $\mu_p$ can be independently set in accordance with the transfer functions A(z) and B(z).

Figure 2:
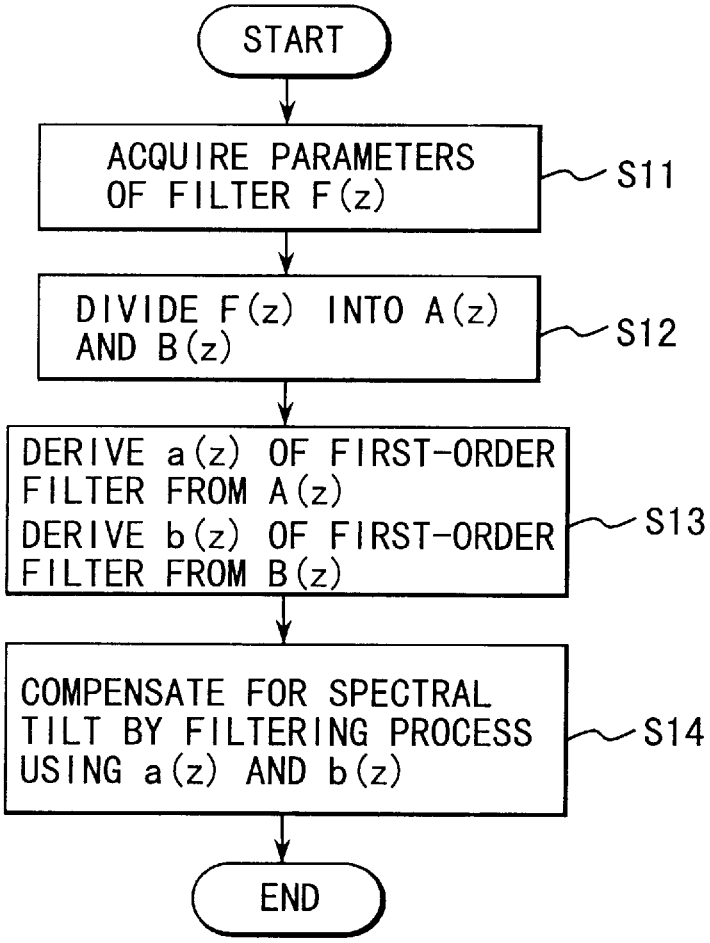
FIG. 2 is a flowchart showing the flow of a process in the post filter according to the first embodiment.

Next, the flow of the process in the post filter 103 is explained with reference to the flowchart shown in FIG. 2.

First, the parameters (filter coefficients) of the transfer function F(z) of the spectrum envelop emphasis filter 112 is acquired (step S11). Next, F(z) are divided into the numerator transfer function A(z) and denominator transfer function B(z) based on the parameters and they are supplied to the parameter calculators 123 and 124 of the filter coefficient calculator 113 (step S12).

In the parameter calculators 123 and 124, the filter coefficients of the transfer functions A(z), B(z) are dealt with as the impulse responses of A(z), B(z), and the parameters $\rho_A$, $\rho_B$ corresponding to the first-order normalized autocorrelation function of the impulse response are calculated according to the equations (4), (5) and are supplied to the adaptive filter 121. In the adaptive filter 121, a(z), b(z) which are the first-order filters are derived from the parameters $\rho_A$, $\rho_B$ according to the equations (6), (7) and are set into the transfer function D(z) indicated by the equation (8) (step S13). The adaptive filter 121 performs a filter processing with the filters a(z), b(z) in the adaptive filter 121 while compensating independently for the tilts of the pole and zero filter transfer functions, thereby compensating for the spectral tilt in the spectrum envelop emphasis filter 112.

Next, a second embodiment is explained. In this embodiment, the external construction is the same as that of FIG. 1 showing the first embodiment, but the design method of the compensation filter 113 is different.

In the first embodiment, the spectral tilt by the transfer function A(z) on the numerator side of the transfer function F(z) of the spectrum envelop emphasis filter 112 is compensated for by the transfer function a(z) on the numerator side of the transfer function D(z) of the adaptive filter 121 and the spectral tilt by B(z) on the denominator side of F(z) is compensated for by b(z) on the denominator side. On the other hand, in the second embodiment, the spectral tilt by the transfer function A(z) on the zero side of F(z) is compensated for by b(z) on the pole side of D(z), and the spectral tilt by B(z) on the pole side of F(z) is compensated for by a(z) on the zero side of D(z). In other words, $\mu_p$ is derived from A(z) and $\mu_z$ is derived from B(z). This is based on the assumption that the compensation can be attained by use of filter coefficients of lower order if the zero point is compensated for by use of the pole and the pole is compensated for by use of the zero point and the efficiency can be enhanced.

Specifically, the filter coefficients of A(z) are dealt with as the LPC coefficients, and the first-order PARCOR coefficient (partial autocorrelation coefficient) $k_A$ which is approximated to the spectrum envelop of A(z) is derived as the first parameter of the adaptive filter 121 by use of the reverse algorithm of the Durbin method. Likewise, the first-order PARCOR coefficient $k_B$ which is approximate to the spectrum envelop of B(z) is derived as the second parameter of the adaptive filter 121. At this time, the parameters $k_A$ and $k_B$ are regarded as the first-order prediction coefficients for the impulse responses of 1/A(z) and 1/B(z), respectively.

In order to compensate for the spectral tilt caused by A(z) and B(z) by use of the two parameters $k_A$ and $k_B$, the transfer function D(z) of the adaptive filter 121 is determined. One concrete example is as follows.

$$D(z)=a(z)/b(z) \tag{9}$$

$$a(z)=1-\eta_B(k_B)z^{-1} \tag{10}$$

$$b(z)=1-\eta_A(k_A)z^{-1} \tag{11}$$

where $\eta^A(\ )$ and $\eta_B(\ )$ are functions for adjusting the values of the parameters $k_A$ and $k_B$.

As one example, $\eta_A(k_A)=0.5\ k_A$ and $\eta_B(k_B)=0.8\ k_B$.

Like the case of the first embodiment, the transfer function of the equations (9) is the first-order pole-zero transfer function expressed by $(1-\mu_z z^{-1})/(1-\mu_p z^{-1})$. $\mu_z$ and $\mu_p$ are filter coefficients whose absolute values are smaller than 1 and which are independent from each other, and in this case, $\mu_z=\eta_B(k_B)$ and $\mu_p=\eta_A(k_A)$.

The conversion formula for conversion from the LPC coefficient to the PARCOR coefficient by reversely using the algorithm of the Durbin method is known in the art and is described in detail in "Digital Speech Processing" (TOKAI University Publishing Circle, by Furui).

Figure 3:
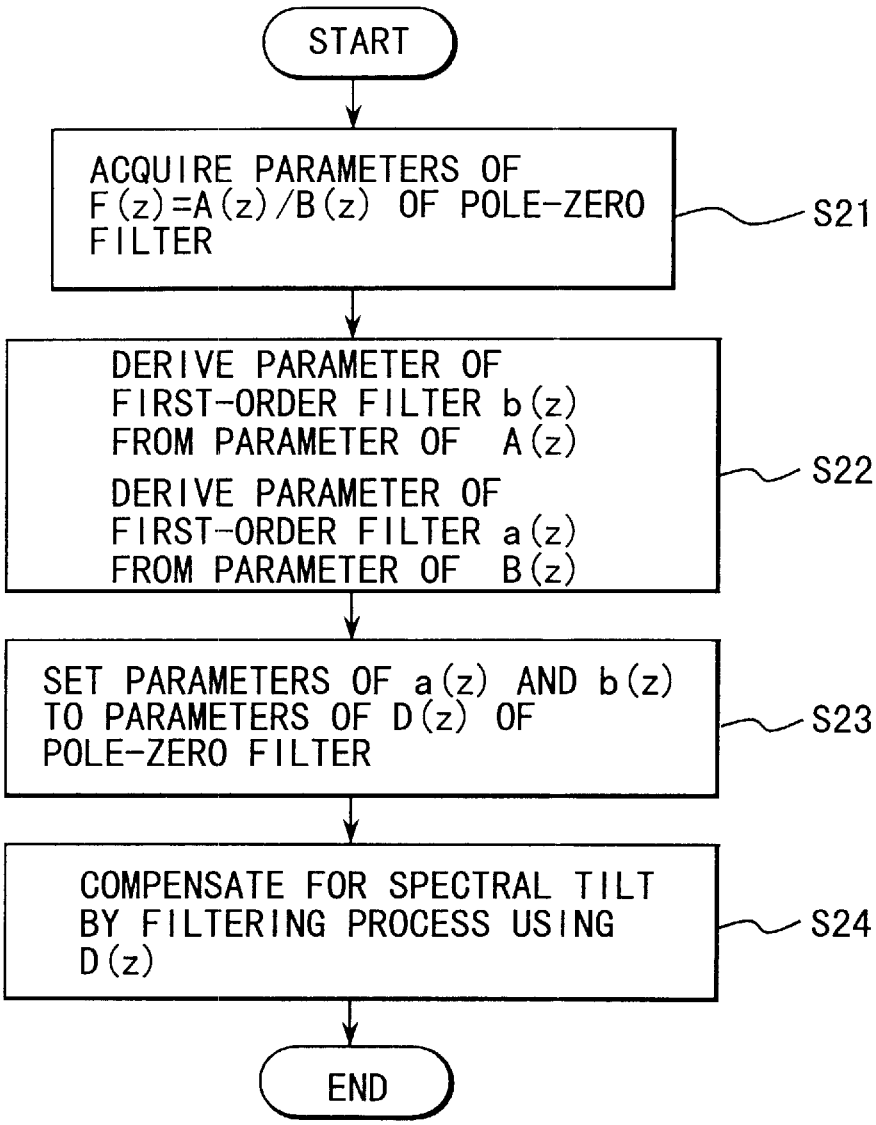
FIG. 3 is a flowchart showing the flow of a process in the post filter according to the second embodiment.

Next, the processing flow in the post filter 103 in this embodiment is explained with reference to the flowchart shown in FIG. 3.

First, parameters of the coefficient A(z) on the zero side and the coefficient B(z) on the pole side in the transfer function F(z)=A(z)/B(z) of the spectrum envelop emphasis filter 112 constructed by the pole-zero filter are acquired (step S21). Then, the parameters $k_A$ and $k_B$ of the first-order filters b(z) and a(z) are respectively derived by calculation from the respective parameters of A(z) and B(z) by use of the reverse algorithm of the Durbin method in the parameter calculators 123 and 124 (step S22), and a(z) and b(z) are set as the parameters of D(z) as indicated in the equation (9) (step S23). The filtering process is effected according to the transfer function D(z) in the adaptive filter 121 to effect the process for compensating for the spectral tilt in the spectrum envelop emphasis filter 112.

Figure 4:
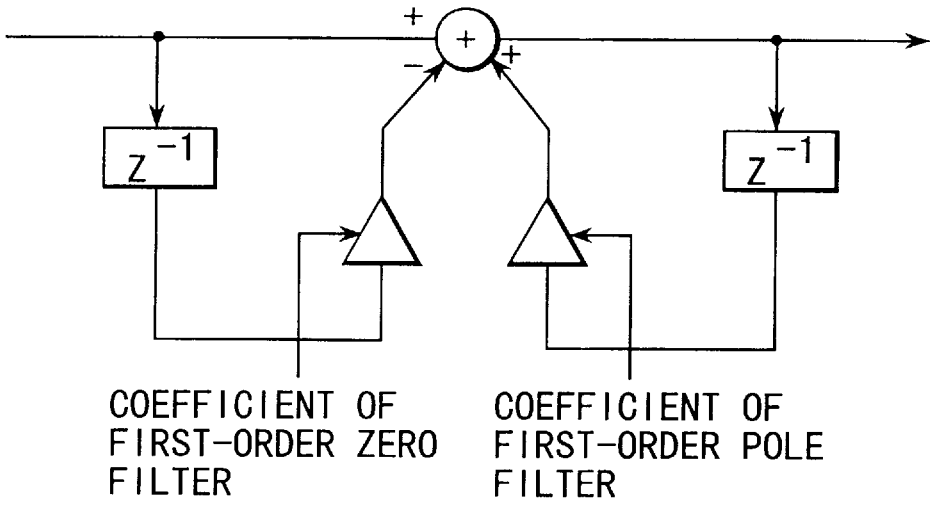
FIG. 4 is a block diagram of an adaptive filter used in this invention.
Figure 5:
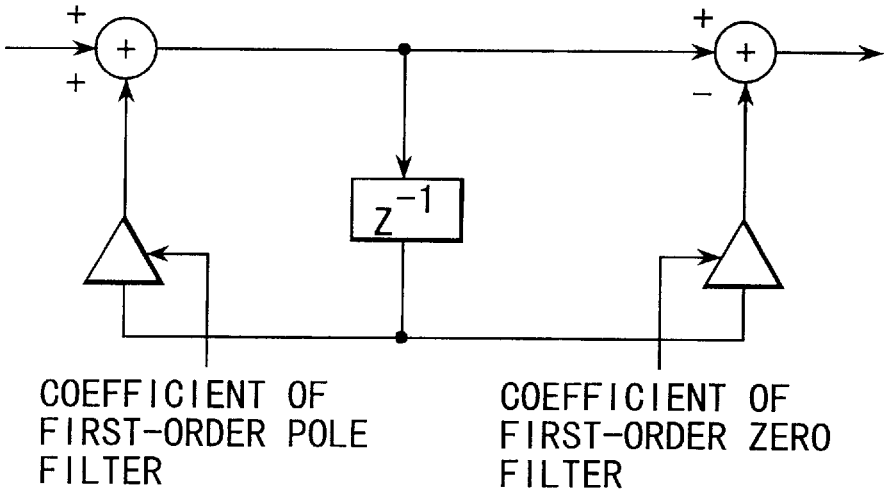
FIG. 5 is a block diagram of another adaptive filter used in this invention.

The concrete construction of the first-order pole-zero adaptive filter 121 described in the first and second embodiments can be expressed by signal flows of FIGS. 4 and 5, for example.

Thus, according to this embodiment, the construction is made to derive $\mu_p$ from A(z) and $\mu_z$ from B(z) so that the spectral tilt can be compensated for by use of lower-order coefficients, that is, less amount of calculations.

Next, a third embodiment is explained.

In the first and second embodiments, a method for constructing the compensation filter 113 using the parameters acquired based on the first-order prediction for pole and zero so as to mainly compensate for the spectral tilt caused by the spectrum envelop emphasis filter 112 is explained.

In the third embodiment, the fact that the spectral irregularity can be compensated for in addition to the spectral tilt by using a method based on the higher-order prediction is explained. This embodiment has a feature that the second-order or higher-order prediction is used instead of the first-order prediction in the first and second embodiments and the external construction thereof is the same as that shown in FIG. 1 in the first and second embodiments. The effect obtained by using the higher-order prediction as in this embodiment is explained below.

If a compensation filter 113 is constructed by use of second-order coefficients for pole and zero, part of the characteristics of the spectrum envelop emphasis filter 112 for emphasizing the irregularity of the spectrum envelop can be suppressed. This is based on the property of the prediction filter. That is, part of the spectrum envelop which is suppressed lies in the frequency range near the first formant which is most strongly emphasized in the normal post filter. Therefore, if the compensation filter 113 is constructed by use of second-order coefficients, the effect that the formant of another frequency range which is difficult to be emphasized in the normal post filter can be preferentially emphasized can be attained. If the order of the prediction coefficient is further raised, the irregularity of the spectrum envelop of the speech can be emphasized in a frequency range narrower than in the case wherein the second-order prediction coefficient is used. If the above method is used, the formant in the high frequency domain of vowel which is difficult to be emphasized in the conventional post filter can be relatively easily emphasized without using a band-pass filter.

In this embodiment, a highly advanced spectral tilt compensating method for compensating for not only the tilt of the spectrum envelop emphasis filter but also the unnecessary spectral tilt (pitch tilt) caused by using the pitch harmonics emphasis filter is explained. The pitch harmonics emphasis filter is used in the post filter as shown in FIG. 1 in some cases and used in the speech signal reconstructor in other cases, but in this embodiment, an example of using the pitch harmonics emphasis filter for an excitation signal of a synthesis filter in the speech signal reconstructor is explained.

Figure 6:
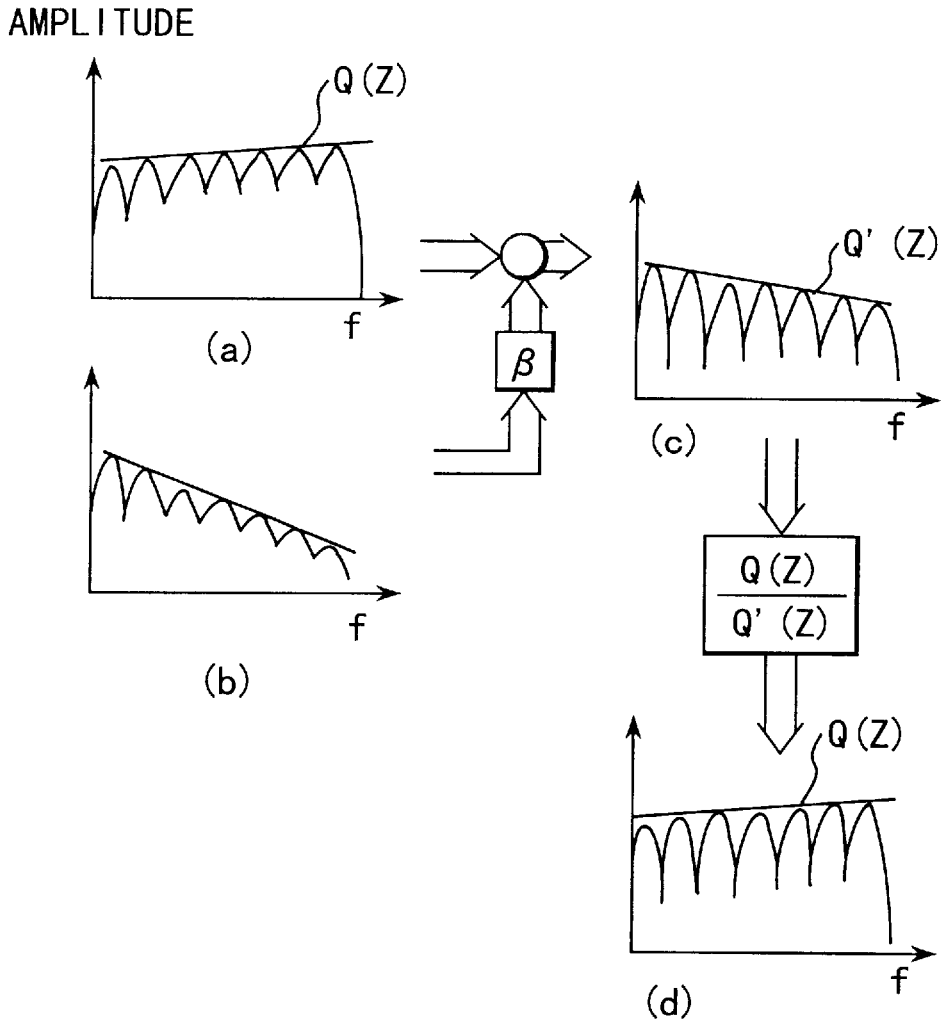
FIG. 6 is a diagram for illustrating the basic function of a pitch harmonics emphasis filter and the principle of the compensation for the spectral tilt by the pitch harmonics emphasis process.

Reference (a) in FIG. 6 is a diagram showing the spectrum shape of an excitation signal of the synthesis filter in the current speech interval and the tilt thereof (which is indicated by a solid line for brevity at (a) in FIG. 6). As shown at (a) in FIG. 6, the spectrum of the excitation signal having a pitch period has a frequency structure having spectral peaks at frequencies which are integer multiples of a frequency corresponding to the pitch period. Ideally, the tilt of the spectrum envelop of the excitation signal of the synthesis filter is flat, but there are many intervals in which the tilt cannot be said to be flat when the spectrum of the actual excitation signal is observed. This is considered to be because analysis of the spectrum envelop is not correctly effected and the synthesis filter cannot completely represent the spectrum envelop of the speech, or the filter characteristic is degraded by an insufficient number of coding bits of the synthesis filter in the speech coding apparatus.

In the speech coding apparatus of analyzing/synthesizing system such as the CELP (Code Excited Linear Prediction) scheme, the degradation of the characteristic of the synthesis filter is compensated for by use of the characteristic of the excitation signal. In such a case, it is clear that the spectrum of the excitation signal which is originally flat will have a tilt and some irregularity. Further, the tilt of the spectrum of the excitation signal is different in each speech interval (for example, frame or sub-frame).

The basic function of the pitch harmonics emphasis filter in the prior art can be explained by use of the waveforms a, b, c of FIG. 6. The waveform b shows an example of the spectral shape of an excitation signal of the synthesis filter in a speech interval which is separated in time by an amount corresponding to the pitch period and the tilt thereof. The process of the pitch harmonics emphasis filter is to make the harmonic structure of the pitch clear as shown by the waveform c by multiplying a signal which is separated in time by an amount corresponding to the pitch period by the pitch gain $\beta$ and adding the result of multiplication to a signal in the current speech interval. The pitch gain $\beta$ is determined by the correlation of an excitation signal which is separated in time by the pitch period.

However, the spectral tilt (which is expressed by Q(z) as shown in the z function domain in FIG. 6) of the excitation signal of the waveform a is changed after the pitch harmonics thereof are emphasized by using the excitation signal of the waveform b which is separated in time from the above excitation signal by an amount corresponding to the pitch period and whose spectral tilt is different from the above tilt and the spectral tilt of the excitation signal of the waveform c after the pitch harmonics emphasis is changed from Q(z) to Q'(z). That is, in this example, Q(z) indicates the right-upward direction but Q'(z) indicates the right-downward direction. According to the experiments by the inventors of this application, it was proved that the conventional pitch harmonics emphasis process had an effect of reducing noise, but it caused the muffled speech sound and partly reduced the clearness of the phoneme because of the change in the spectral tilt of the excitation signal. Particularly, in the condition of tandem in which a speech signal reconstructed by the speech coding/decoding process is coded/decoded and reconstructed again, the muffled speech sound and partial unclearness of the phoneme are amplified, and as a result, the speech tends to be sensed as having an extremely deteriorated speech quality.

In order to solve this problem, in this embodiment, a process for compensating for the spectral tilt (or change) caused by the pitch harmonics emphasis is introduced into the pitch harmonics emphasis process. The compensation process is to recover the spectral tilt Q'(z) of the excitation signal with waveform c obtained by the conventional pitch harmonics emphasis filtering to the original tilt Q(z) while the pitch harmonic structure is kept unchanged as shown by the waveform d. By this compensation process, the problem of deterioration in the phoneme and the muffled speech sound caused by the pitch harmonics emphasis filtering can be significantly suppressed.

That is, in this embodiment, in order to restore the spectral tilt (or spectral envelope) Q'(z) changed as indicated by the waveform c to the original spectral tilt (or spectral envelope) Q(z), the filtering process of Q(z)/Q'(z) or a process for eliminating the influence by Q'(z) and adding the characteristic of Q(z) is effected before or after the pitch harmonics emphasis filtering process. In order to effect the above process, it is necessary to extract at least the characteristic of Q(z).

Figure 7:
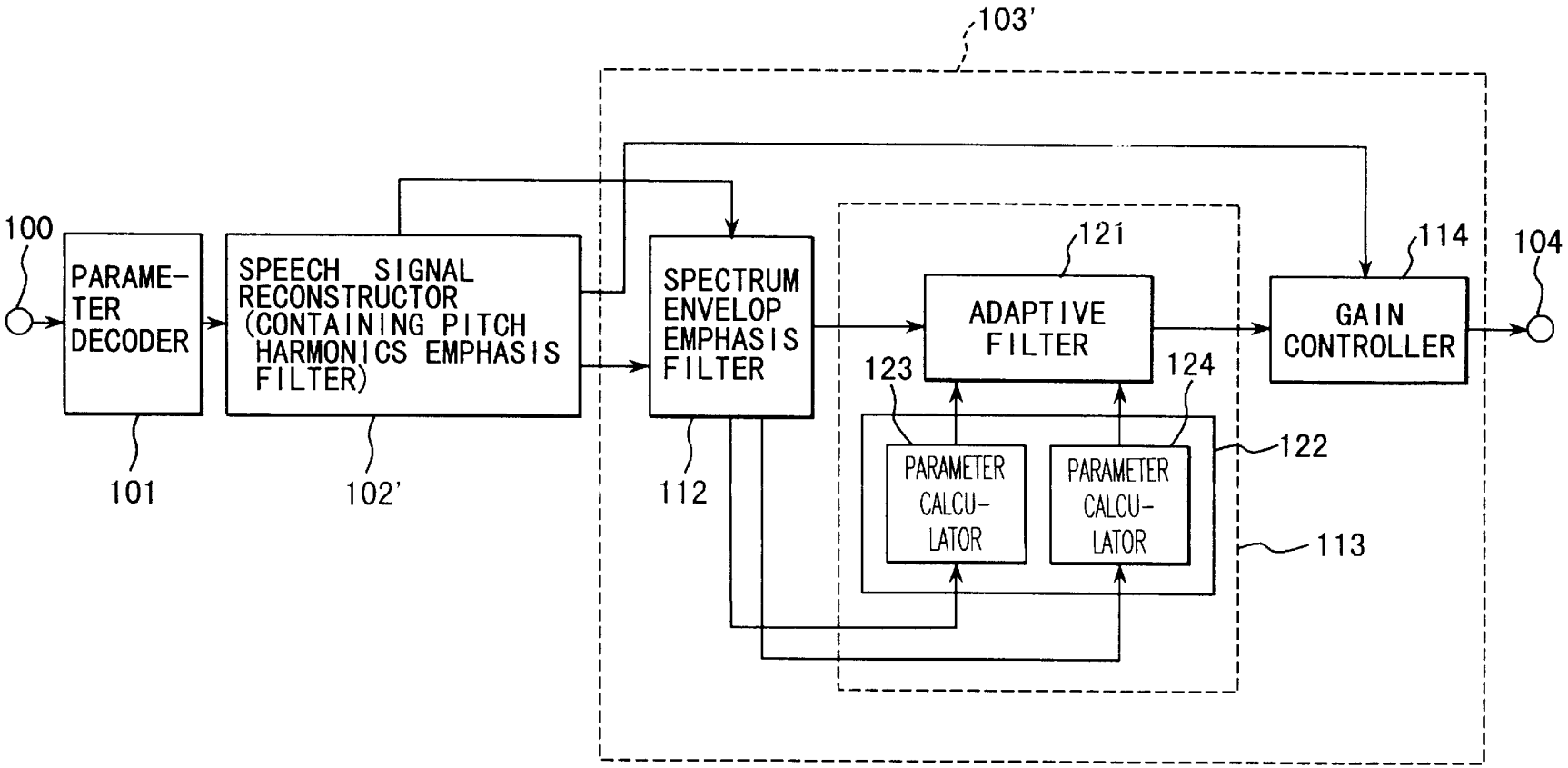
FIG. 7 is a block diagram of a speech decoding apparatus having a post filter incorporated therein according to a fourth embodiment.

FIG. 7 is a block diagram showing a speech decoding apparatus according to this embodiment which has a function of compensating for the spectral tilt (pitch tilt) of the excitation signal caused by the pitch harmonics emphasis filtering process. The speech decoding apparatus includes a speech signal reconstructor 102' and a post filter 103' which are different in construction from corresponding portions of FIG. 1. The speech signal reconstructor 102' is constructed to emphasize the pitch harmonics of the excitation signal by using the pitch harmonics emphasis filter before inputting the excitation signal to the synthesis filter and synthesizing the speech signal. That is, in this embodiment, the pitch harmonics emphasis filter provided in the post filter 103 of FIG. 1 is contained in the speech signal reconstructor 102' and the pitch harmonics emphasis filter 111 provided in the post filter 103 of FIG. 1 is not contained in the post filter 103'.

Figure 8:
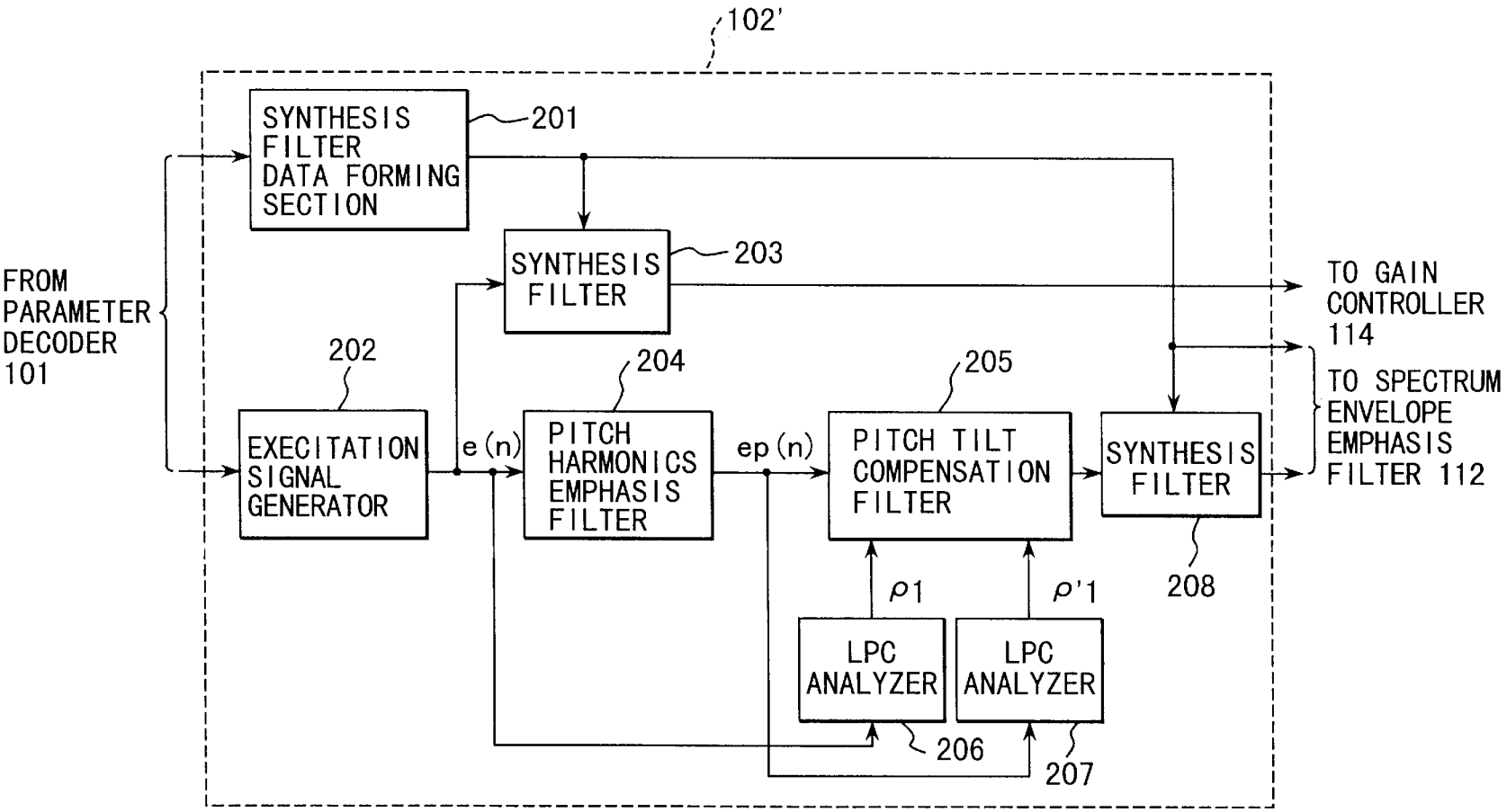
FIG. 8 is a block diagram of a speech signal reconstructor in FIG. 7.

FIG. 8 is a block diagram showing the detail construction of the speech signal reconstructor 102' of FIG. 7. The speech signal reconstructor 102' includes a synthesis filter data forming section 201, excitation signal generator 202, first synthesis filter 203, pitch harmonics emphasis filter 204, pitch tilt compensation filter 205, first and second LPC analyzers 206, 207, and second synthesis filter 208. The synthesis filter data forming section 201 and excitation signal generator 202 form an excitation signal e(n) of the first synthesis filter 203 and synthesis filter data for determining filter coefficients of the synthesis filters 203, 208 based on parameter data decoded by the parameter decoder 101 in FIG. 7.

The excitation signal e(n) generated in the excitation signal generator 202 is input to the first synthesis filter 203 and to the pitch harmonics emphasis filter 204 and the first LPC analyzer 206. The excitation signal ep(n) whose pitch harmonics are emphasized by the pitch harmonics emphasis filter 204 are input to the pitch tilt compensation filter 205 and second LPC analyzer 207. In the first and second LPC analyzers 206 and 207, the filter coefficient of the pitch tilt compensation filter 205 is created. The excitation signal in which the pitch tilt is compensated for by the pitch tilt compensation filter 205, that is, the spectral tilt is compensated for by the pitch harmonics emphasis filter 204 is input to the synthesis filter 208 to reconstruct the speech signal. The reconstructed speech signal is further input to the spectrum envelop emphasis filter 112 in the post filter 103'. The synthesis filter data formed in the synthesis filter data forming section 201 is used for determining the transfer function F(z) of the spectrum envelop emphasis filter 112 indicated by the equation (1). Further, an output signal of the first synthesis filter 203 is used for determining the gain of the gain controller 114 in the post filter 103'.

Next, the pitch harmonics emphasis filter 204, pitch tilt compensation filter 205 and first and second LPC analyzers 206, 207 shown in FIG. 8 are explained in more detail.

The first LPC analyzer 206 effects the Lth-order linear prediction analysis for the excitation signal e(n) in a preset interval of the reconstructed speech signal, for example, in one sub-frame or one frame interval to derive L prediction coefficients. The method of linear prediction analysis is well known in the art and the detail explanation therefor is omitted here. The prediction coefficient $\rho_1$ in the case of L=1 can be derived by the following equation (12).

$$\rho_1=\Sigma e(n)e(n+1)/\Sigma e(n)e(n) \tag{12}$$

In this case, the spectral tilt characteristic Q(z) explained with reference to FIG. 6 can be expressed by the following equation (13).

$$Q(z)=1/(1-g(\rho_1)n^{-1}) \tag{13}$$

where g( ) is a function of adjusting the prediction coefficient.

In one example, $g(\rho_1)=\eta\rho_1$ and a value larger than 0 and not larger than 1 is used as $\eta$. If L is set to two or more, the more specific schematic spectral form of e(n) can be expressed by Q(z). In this case, Q(z) can be expressed as follows.

$$Q(z)=1/(1-\rho_1 z^{-1}-\rho_2 z^{-2}-\ldots-\rho_L z^{-L})$$

where $\rho_1, \rho_2, \ldots, \rho_L$ indicate L prediction coefficients derived by the Lth-order linear prediction analysis.

The pitch harmonics emphasis filter 204 receives the excitation signal e(n) and outputs the excitation signal ep(n) whose pitch harmonics are emphasized. As the pitch harmonics emphasis filtering method, the following equation (14) can be used, for example.

$$ep(n)=e(n)+\beta e(n-T),\ n=0, 1, \ldots, N-1 \tag{14}$$

where T indicates a pitch period, N indicates the length of an interval used for pitch harmonics emphasis, and $\beta$ indicates a pitch gain.

The value of $\beta$ can be determined based on a value obtained by the pitch analysis and is generally set in the range of $0<\beta<$approx. 0.7. As another method, a method for using a fixed value previously prepared according to the degree of the presence or absence of the pitch period as $\beta$ is effective. As one example, the value of $\beta$ is determined such that $\beta=0$ at the time of no pitch period and $\beta=0.6$ when the pitch period property appears relatively strongly.

In the second LPC analyzer 207, the excitation signal ep(n) whose pitch harmonics are emphasized is subjected to the Mth-order linear prediction analysis to derive M prediction coefficients. A prediction coefficient $\rho_1'$ in the case of can be derived by the following equation (15).

$$\rho_1'=\Sigma ep(n)ep(n+1)/\Sigma ep(n)ep(n) \tag{15}$$

In the case of M=1, the spectral tilt characteristic Q'(z) explained with reference to FIG. 6 can be expressed by the following equation (16).

$$Q'(z)=1/(1-f(\rho_1')z^{-1}) \tag{16}$$

where f( ) is a function of adjusting the prediction coefficient. As one example, $f(\rho_1')=\eta_1'$ and a value larger than 0 and not larger than 1 is used as $\eta'$. If M is set to two or more, the more specific schematic spectral form of ep(n) can be expressed by Q'(z). In this case, Q'(z) can be expressed by the following equation (17).

$$Q'(z)=1/(1-\rho_1' z^{-1}-\rho_2' z^{-2}-\ldots-\rho_M' z^{-M}) \tag{17}$$

where $\rho_1', \rho_2', \ldots, \rho_M'$ can indicate M prediction coefficients derived by the Mth-order linear prediction analysis.

The pitch tilt compensation filter 205 effects the filtering process whose transfer function is Q(z)/Q'(z) by use of Q'(z) and Q(z) based on the prediction coefficients from the LPC analyzers 206, 207 for the excitation signal ep(n) after the pitch harmonics emphasis and then supplies the signal eq(n) whose pitch tilt is compensated for to the second synthesis filter 208. In the case of L=1 and M=1, the following equation (18) can be derived by use of the equations (13) and (16).

$$Q(z)/Q'(z)=(1-f(\rho_1')z^{-1})/(1-g(\rho_1)z^{-1}) \tag{18}$$

Further, when $\eta$ and $\eta'$ are used and $\eta=\eta'=1$, the following equation (19) can be obtained.

$$Q(z)/Q'(z)=(1-\rho_1' Z^{-1})/(1-\rho_1 z^{-1}) \tag{19}$$

Figure 9:
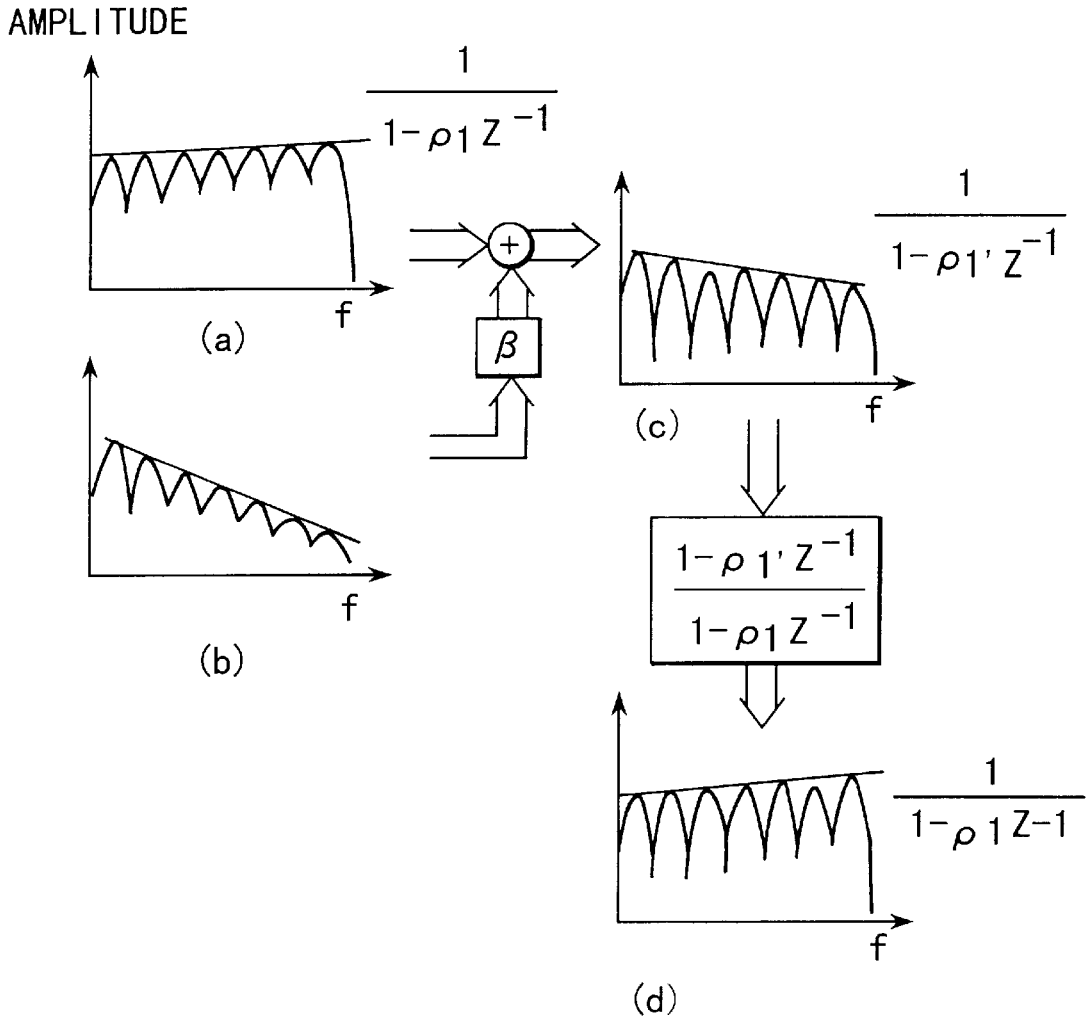
FIG. 9 is a diagram for illustrating the function of a pitch harmonics emphasis filter in the fourth embodiment and the operation of the compensation for the spectral tilt by the pitch harmonics emphasis process.

FIG. 9 is a diagram more specifically showing Q(z) and Q'(z) in the case of L=1, M=1, $\eta=1$ and $\eta'=1$, for illustrating the principle of the compensation for the spectral tilt shown in FIG. 6.

Referring to FIG. 8 again, the speech signal reconstructor 102' is further explained. It is effective to use a method for supplying a signal obtained by adjusting the power of eq(n) approximately equal to the power of e(n) to the synthesis filter 208 as eq(n) when the excitation signal eq(n) after compensation of the pitch tilt is supplied to the second synthesis filter 208. The second synthesis filter 208 is excited by the excitation signal eq(n) in which the pitch tilt or the spectral tilt caused by the pitch harmonics emphasis is compensated for and synthesizes a reconstructed speech signal whose pitch harmonics are emphasized. The reconstructed speech signal is supplied to the post filter 103'. In order to supply power information from the speech signal reconstructor 102' to the gain controller 114 of the post filter 103', the excitation signal e(n) generated in the excitation signal generator 202 is input to the first synthesis filter 203 so as to derive a speech signal whose pitch harmonics are not emphasized. If the excitation signal eq(n) whose power is adjusted as described above is used, it is effective to use a method for supplying a speech signal whose pitch harmonics are emphasized and which is an output of the second synthesis filter 208 to the gain controller 114 without using the first synthesis filter 203.

Figure 10:
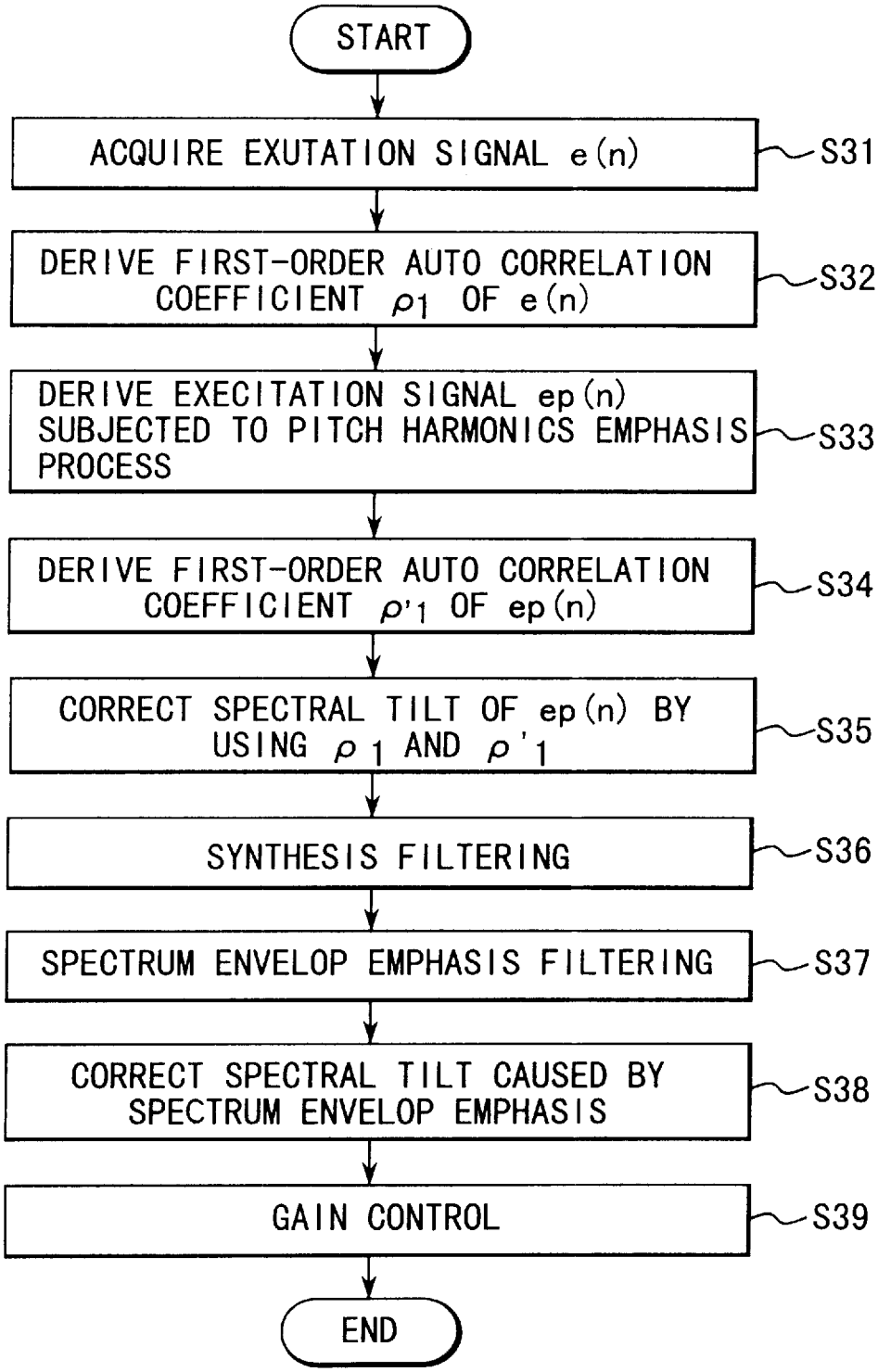
FIG. 10 is a flowchart showing the flow of a process in the fourth embodiment.

Next, the flow of the process in this embodiment is explained with reference to the flowchart of FIG. 10.

First, the excitation signal e(n) of the first synthesis filter 203 is created in the excitation signal generator 202 (step S31), and the first-order autocorrelation coefficient $\rho_1$ for the excitation signal e(n) is derived in the first LPC analyzer 206 (step S32). The excitation signal e(n) is supplied to the pitch harmonics emphasis filter 204 to derive an excitation signal ep(n) whose pitch harmonics are emphasized (step S33) and the first-order autocorrelation coefficient $\rho_1'$ for the excitation signal ep(n) is derived in the second LPC analyzer 207 (step S34). The pitch tilt, that is, the spectral tilt of the excitation signal ep(n) whose pitch harmonics are emphasized is compensated for by the pitch tilt compensation filter 205 by using the autocorrelation coefficients $\rho_1$ and $\rho_1'$ (step S35). Then, the excitation signal eq(n) whose pitch tilt is compensated for is input to the second synthesis filter 208 for synthesis filtering so as to reconstruct the speech signal. The above steps S31 to S35 construct the process of the speech signal reconstructor 102'.

Next, the speech signal reconstructed in the speech signal reconstructor 102' as described above is input to the post filter 103', the spectrum envelop emphasis filtering process is first effected (step S37) by the spectrum envelop emphasis filter 112 as in the former embodiment and then the spectral tilt caused by the spectrum envelop emphasis filtering process is compensated for by the compensation filter 103 (step S38). Finally, the gain is smoothly controlled by the gain controller 114 so that the speech signal after the process by the post filter 103' will have substantially the same power as that of the speech signal obtained before the process and a thus obtained speech signal is output (step S39).

As another practical method of the fourth embodiment, it is possible to use a method for extracting the spectral tilt (or schematic form) Q(z) of the excitation signal prior to the pitch harmonics emphasis in the current interval, effecting the emphasis filtering process for the pitch harmonics after making flat the spectral tilt contained in the signal used for pitch harmonics emphasis, and supplying the characteristic of Q(z) to the excitation signal obtained after the pitch harmonics emphasis. As the method for more stably effecting the pitch tilt compensation, it is possible to use Q(z/γ) instead of Q(z) and use Q'(z/γ') instead of Q'(z). γ, γ' can be set in the range of 0<γ<1, 0<γ'<1.

Next, a fifth embodiment is explained. This embodiment is an example in which the spectral tilt compensation process is effected by use of an adaptive filter of transfer function Tpz(z) which is improved over the adaptive filter of transfer function D(z) explained in the second embodiment, and particularly, it has an effect that the clearness in the consonant interval is improved and the distinct sound can be obtained.

Figure 11:
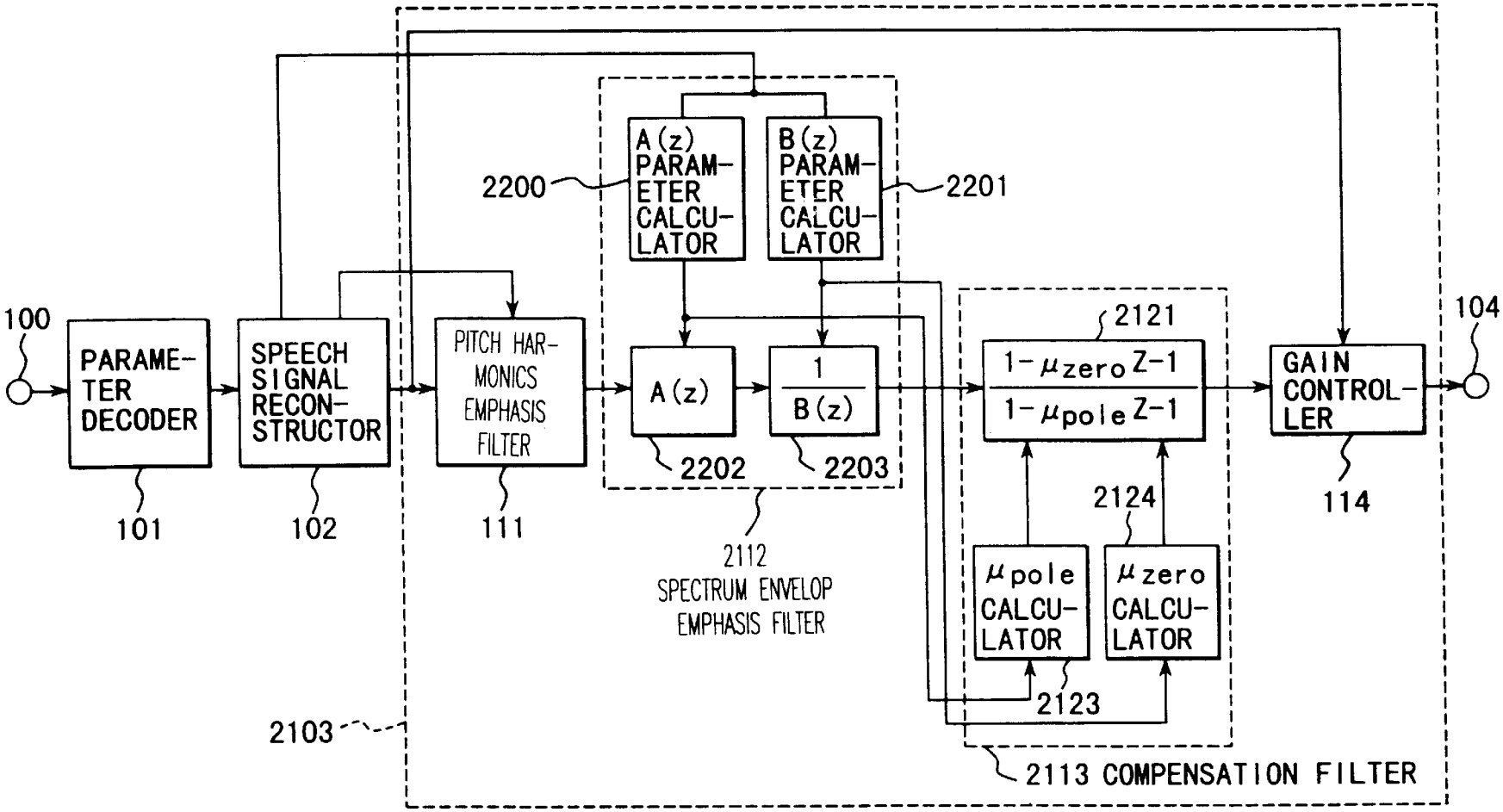
FIG. 11 is a block diagram of a speech decoding apparatus having a post filter incorporated therein according to a fifth embodiment.

FIG. 11 shows an embodiment in which a post filter according to this invention is applied to the final stage of a speech decoding apparatus and blocks having the same functions as the corresponding blocks of FIG. 1 are denoted by the same reference numerals. A reconstructed speech signal S(n) is reconstructed via the parameter decoder 101 and speech signal reconstructor 102 from coded data (speech compressed information constructed in the parameter form) supplied from the speech coding apparatus on the transmission side and received at the input terminal 100 and the reconstructed speech signal is supplied to a post filter 2103, and a final output speech signal So(n) is generated. The post filter 2103 in this embodiment is explained in detail below.

The post filter 2103 includes a pitch harmonics emphasis filter 111, spectrum envelop emphasis filter 2112, compensation filter 2113 and gain controller 114, and the above elements are constructed as follows.

The transfer function F(z) of the spectrum envelop emphasis filter 2112 is expressed by F(z)=A(z)/B(z) as described before, but in order to make the process effected in the spectrum envelop emphasis filter 112 clearer, it is divided into more specific process blocks and explained.

Ten LPC coefficients (in this example, the tenthorder LPC coefficient is used) input from the speech signal reconstructor 102 are input to a A(z) parameter calculator 2200 and a B(z) parameter calculator 2201, and the parameter calculators 2200 and 2201 respectively calculate and output parameters awi (i=1 to 10) of A(z) and parameters bwi (i=1 to 10) of B(z).

A signal input to the post filter 2103 is subjected to the process for emphasizing the repetition of the pitch period by the pitch harmonics emphasis filter 111, subjected to the filtering process by the zero filter 2202 having the transfer function of A(z) among the spectrum envelop emphasis characteristic, and then filtered by the pole filter 2203 having the transfer function of 1/B(z).

The speech signal whose spectrum envelop is thus emphasized by the spectrum envelop emphasis filter 112 is further compensated for the unnecessary spectral tilt in the compensation filter 2113. The transfer function Tpz(z) of an adaptive filter 2121 for effecting the concrete filtering process in the compensation filter 2113 is expressed by the following equation (20)

$$Tpz(z)=(1-\mu_{zero}z^{-1})/(1-\mu_{pole}z^{-1}) \tag{20}$$

That is, like the first embodiment, the adaptive filter 2121 is formed of a first-order pole-zero filter in which the transfer function of z transform domain is expressed by:

$$(1-\mu_z z^{-1})/(1-\mu_p z^{-1})$$

(where $\mu_z$, $\mu_p$ are independent filter coefficients whose absolute values are smaller than 1).

At the time of filtering process by the adaptive filter 2121, it is first necessary to previously derive two filter coefficients $\mu_{zero}$, $\mu_{pole}$ for determining the characteristic of the adaptive filter 2121, but the filter coefficients $\mu_{zero}$, $\mu_{pole}$ are independently derived by a $\mu_{zero}$ calculator 2124 and $\mu_{pole}$ calculator 2123 as described below.

The $\mu_{pole}$ calculator 2123 receives the parameter of A(z) which is an output of the parameter calculator 2200, derives an autocorrelation coefficient $r_{1zero}$ based on the received parameter, and then calculates $\mu_{pole}$ according to the following equations.

$$\mu_{pole}' = C_o\, r_{1zero} \qquad (r_{1zero} < Th) \tag{21}$$

$$\mu_{pole}' = C_1\, r_{1zero} \qquad (r_{1zero} \geqq Th)$$

$$\mu_{pole} = C_2\, \mu_{pole}' + (1 - C_2)\ \text{last_}\mu_{pole} \tag{22}$$

In this case, weighting factors $C_0$, $C_1$, $C_2$ and the threshold value Th are adjusting values, $0<C_1<C_0\leqq 1$, $0<C_2\leqq 1$, and Th is a value approximately equal to 0. Further, last_$\mu_{pole}$ indicates $\mu_{pole}$ in the immediately preceding speech interval (for example, preceding sub-frame). $r_{1zero}$ is a first-order autocorrelation coefficient (which is equal to the first-order PARCOR coefficient) calculated by use of the filter coefficients awi1 to awi10 of the zero filter 2202 having the transfer function A(z) on the numerator side in the spectrum envelop emphasis filter 2112. The value of $r_{1zero}$ can be derived as an autocorrelation value obtained by shifting the impulse response series of 1/A(z) by one sampling time, but by reversely using the recursive algorithm of the Durbin scheme described before (or the recursive algorithm of Levinson or Levinson-Durbin algorithm) as a more efficient method, it becomes possible to derive the first-order autocorrelation coefficient by a small amount of calculations without actually calculating the impulse response.

The $\mu_{zero}$ calculator 2124 receives the parameter of B(z) which is an output of the parameter calculator 2201 and derives an autocorrelation coefficient $r_{1pole}$ based on the received parameter. The coefficient $\mu_{zero}$ is calculated according to the following equation (23).

$$\mu_{zero}=C_3 r_{1pole} \tag{23}$$

In this case, $C_3$ is an adjustment value of the weighting factor and it is preferable that $0<C_3<1$. $r_{1pole}$ is a first-order autocorrelation coefficient (which is equal to the first-order PARCOR coefficient) calculated by use of the filter coefficients bw1 to bw10 of the pole filter having the transfer function B(z) on the denominator side in the spectrum envelop emphasis filter 2112. The value of $r_{1pole}$ can be derived as an autocorrelation value obtained by shifting the impulse response series of 1/B(z) by one sampling time, but by reversely using the recursive algorithm of the Durbin scheme described before (or the recursive algorithm of Levinson or Levinson-Durbin algorithm) as a more efficient method, it becomes possible to derive $r_{1pole}$ by a small amount of calculations without actually calculating the impulse response.

According to the experiments by the inventors of this application, it was proved that the improvement of the speech quality was significant when the adjustment values were set to such values that $C_0$=0.9, $C_1$=0.4, $C_2$=0.7, Th=0.0, $C_3$=0.7. By substituting the above values, the equations (21), (22) and (23) can be rewritten as follows:

$$\mu_{pole}' = 0.9\, r_{1zero} \quad (r_{1zero} < 0.0) \tag{24}$$

$$\mu_{pole}' = 0.4\, r_{1zero} \quad (r_{1zero} \leqq 0.0)$$

$$\mu_{pole} = 0.7\, \mu_{pole}' + 0.3\text{last_}\mu_{pole} \tag{25}$$

$$\mu_{pole} = 0.7\, r_{1pole} \tag{26}$$

The adaptive filter 2121 constructs an adaptive filter of transfer function of Tpz(z) of first-order pole-zero filter by using the coefficients calculated as described above and effects the filtering process for a speech signal whose spectrum envelop is emphasized and which is input thereto.

Finally, the gain of the speech signal is smoothly controlled by the gain controller 114 so that the output speech signal processed by the post filter 103 will have substantially the same power as the input speech signal obtained before the processing and the gain-controlled speech signal is output as an output speech signal of the post filter 2103.

Figure 12:
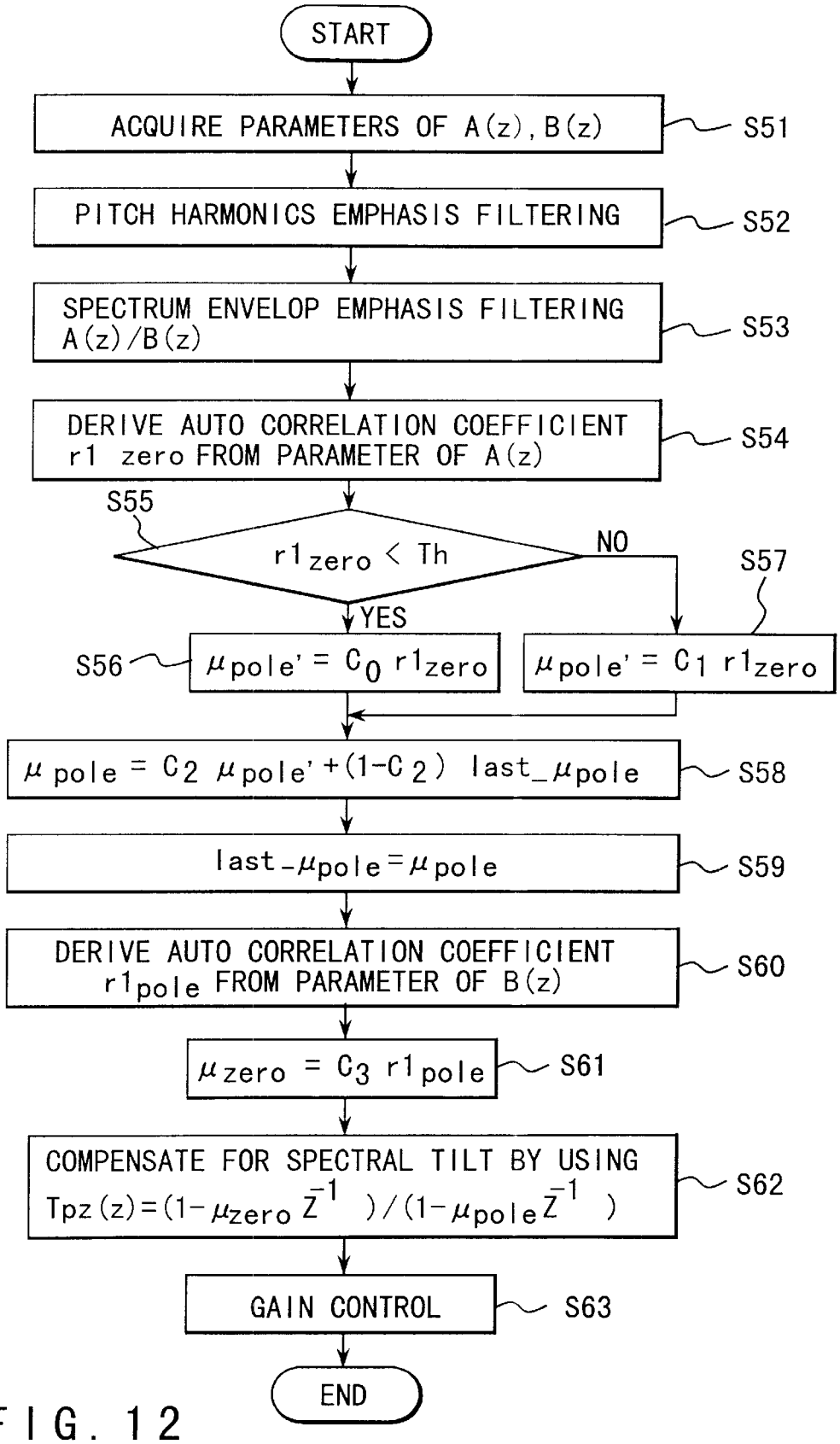
FIG. 12 is a flowchart showing the flow of a process in the post filter according to the fifth embodiment.

Next, the flow of the process in the post filter in this embodiment is explained with reference to the flowchart of FIG. 12.

First, parameters awi (i=1 to 10) and parameters bwi (i=1 to 10) of the respective filters A(z) of B(z) constructing the spectrum envelop emphasis filter F(z) (=A(z)/B(z)) are acquired (step S51). One example of the concrete method of the step S51 is to calculate the following equations (27) and (28) by using the LPC coefficients αi (i=1 to 10) in the current speech interval from the speech signal reconstructor 102.

$$awi=(\gamma 1)^i \alpha_i \ (i=1 \text{ to } 10) \tag{27}$$

$$bwi=(\gamma 2)^i \alpha_i \ (i=1 \text{ to } 10) \tag{28}$$

In this case, A(z) and B(z) can be expressed by the following equations (29) and (30).

$$A(z)=1+\Sigma awiz^{-i} \ (i=1 \text{ to } 10) \tag{29}$$

$$B(z)=1+\Sigma bwiz^{-i} \ (i=1 \text{ to } 10) \tag{30}$$

If the definition of the sign of the LPC coefficient is different, the equations (29) and (30) can be replaced by the following equations (29') and (30').

$$A(z)=1-\Sigma awiz^{-i} \ (i=1 \text{ to } 10) \tag{29'}$$

$$B(z)=1-\Sigma bwiz^{-i} \ (i=1 \text{ to } 10) \tag{30'}$$

In this case, γ1 and γ2 are parameters for adjusting the degree of spectrum emphasis and are generally set in the range of 0<γ1<γ2<1.

Then, the filtering process (step S52) for pitch harmonics emphasis for the input speech signal and the filtering process (step S53) for spectrum envelop emphasis are effected.

Next, the spectral tilt is compensated for by using an adaptive filter with transfer function of Tpz(z) which is the feature of this embodiment as will be described below. First, an autocorrelation coefficient $r_{1zero}$ is derived from the parameter awi (i=1 to 10) of A(z) (step S54), the value of $r_{1zero}$ is compared with the threshold value Th (step S55), and if $r_{1zero}$ is smaller than Th, a value obtained by multiplying $r_{1zero}$ by $C_0$ is set as $\mu_{pole}'$ (step S56), and if $r_{1zero}$ is larger than Th, a value obtained by multiplying $r_{1zero}$ by $C_1$ is set as $\mu_{pole}'$ (step S57). A value obtained by interpolating $\mu_{pole}'$ and last_$\mu_{pole}$ corresponding to the preceding $\mu_{pole}$ by use of $C_2$ is set as $\mu_{pole}$ in the current speech interval (step S58). The value of thus derived $\mu_{pole}$ is stored in last_$\mu_{pole}$ for the interpolation process in the next speech interval (step S59).

After this, an autocorrelation coefficient $r_{1pole}$ is derived from the parameter bwi (i=1 to 10) of B(z) (step S60) and a value obtained by multiplying $r_{1pole}$ by $C_3$ is set as $\mu_{zero}$ (step S61).

The unnecessary spectral tilt caused by the spectrum envelop emphasis filtering process is compensated for by effecting the filtering process by use of the adaptive filter of transfer function Tpz(z) determined by the thus derived two filter coefficients $\mu_{pole}$ and $\mu_{zero}$ (step S62).

Finally, the gain is smoothly controlled by the gain controller so that the output speech signal processed by the post filter 103 will have substantially the same power as the input speech signal obtained before the processing and the gain controlled speech signal is output as an output speech signal of the post filter (step S63).

It is also possible for the adaptive filter used in this embodiment to have its own filter gain and effect the above process. In this case, the transfer function Tpz(z) of the adaptive filter can be expressed by the following equation (31).

$$Tpz(z)=Gpz(1-\mu_{zero}z^{-1})/(1-\mu_{pole}z^{-1}) \tag{31}$$

Further, the filter gain Gpz expressed by the following equation (32) can be used.

$$Gpz=(1-\gamma_{pole}\mu_{pole})/(1-\gamma_{zero}\mu_{zero}) \tag{32}$$

where $\gamma_{pole}$ and $\gamma_{zero}$ are fixed adjustment values set in a range of $0<\gamma_{pole}$, γzero<1.

In this case, since the adaptive filter with transfer function of Tpz(z) can be constructed to have a simplified self-controlling function for gain, it is effective in the case of the construction of the post filter in which the compensation filter for compensating for the spectral tilt is inserted in the succeeding stage of the gain controller.

Thus, according to this embodiment, in addition to the effect of the former embodiment, the compensation filter 2113 can be made to have compensation characteristics respectively suitable for consonants and vowels to further effectively improve the speech quality by using the weighting factors set in a relation of $C_1<C_3<C_0$, deriving $\mu_{pole}$ from a value obtained by weighting $r_{1zero}$ by the factor $C_0$ when the first autocorrelation coefficient $r_{1zero}$ derived from the parameter of A(z) is smaller than the threshold value (Th) which is approximately equal to 0 or a value obtained by weighting $r_{1zero}$ by the factor $C_1$ when $r_{1zero}$ is larger than the threshold value Th, deriving $\mu_{zero}$ from a value obtained by weighting the second autocorrelation coefficient $r_{1pole}$ derived from the parameter of A(z) by the weighting factor $C_3$, and selectively using the weighting factor according to the result of comparison between the autocorrelation coefficient and the threshold value Th based on the fact that the speech in an interval in which $r_{1zero}$ is smaller than the threshold value Th is a speech such as a consonant which is strong in the high frequency domain and the speech in an interval in which $r_{1zero}$ is larger than the threshold value Th is a speech such as a vowel which is strong in the low frequency domain.

Next, a post filter having an improved gain controller is explained as a sixth embodiment.

Figure 13:
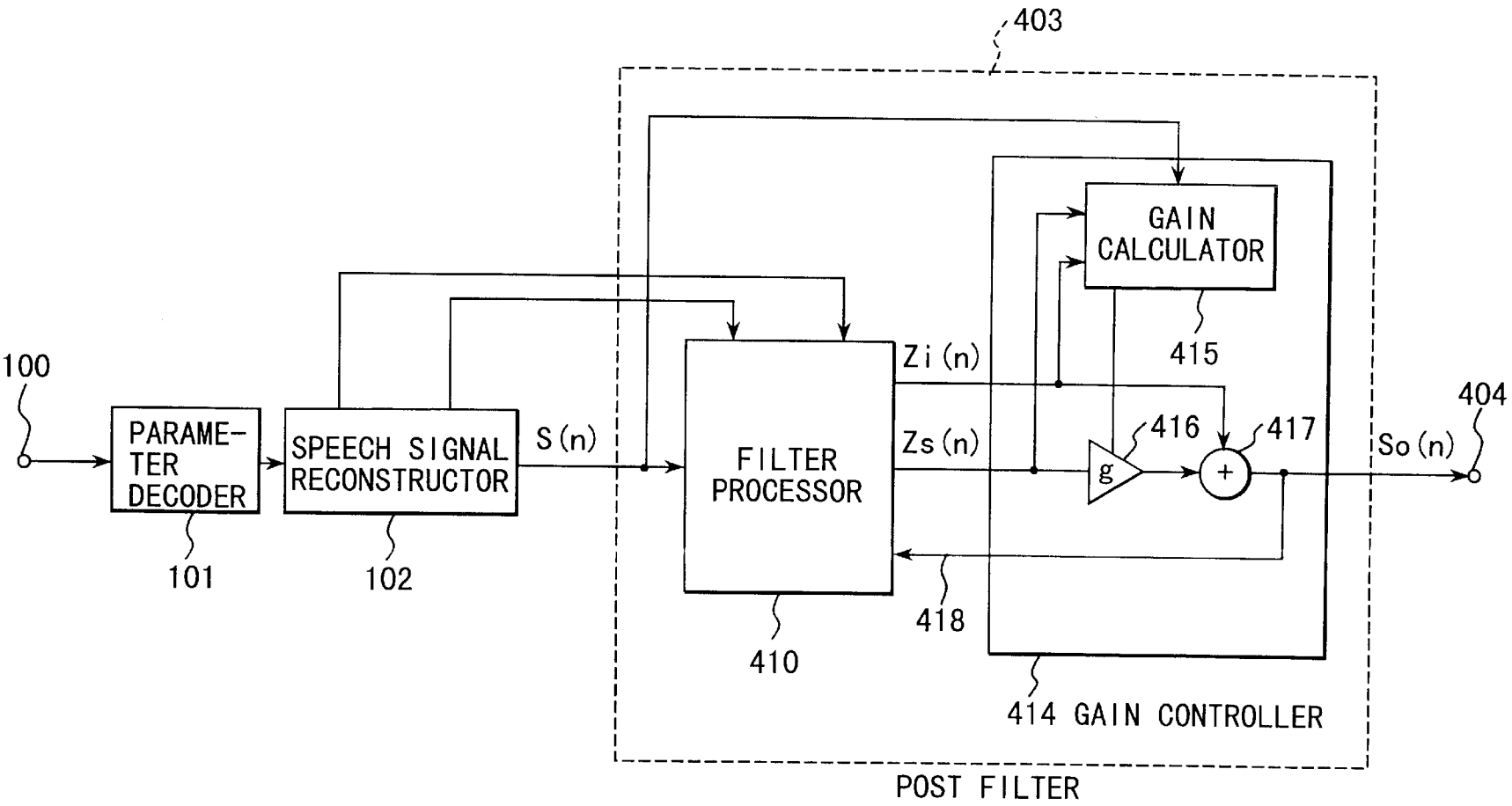
FIG. 13 is a block diagram of a speech decoder having a post filter incorporated therein according to an eleventh embodiment.

FIG. 13 shows an example in which the post filter according to this embodiment is applied to the final stage of a speech decoding apparatus and blocks having the same functions as corresponding blocks in FIG. 1 are denoted by the same reference numerals. That is, a reconstructed speech signal S(n) is reconstructed via the parameter decoder 101 and speech signal reconstructor 102 from coded data (speech compressed information constructed in a parameter form) supplied from the speech coding apparatus on the transmission side and received at the input terminal 100 and the reconstructed speech signal is supplied to a post filter 403, and a final output speech signal So(n) is generated. The post filter 403 in this embodiment is explained in detail below.

The post filter 403 includes a filter processor 410 and gain controller 414. The filter processor 410 effects various filtering processes in the post filter 403. Specifically, the filter processor 410 effects the spectrum envelop emphasis filtering process, pitch harmonics emphasis filtering process and spectral tilt compensation filtering process based on information such as the pitch period and LPC coefficient $\alpha_i$ (i=1 to 10) from the speech signal reconstructor 102. The filter processor 410 is not required to effect all of the above processes and, for example, it may not effect the pitch harmonics emphasis filtering process.

The filter processor 410 derives the zero input response Zi(n) and zero state response Zs(n) of the filter of a length corresponding to the current speech interval and outputs them to the gain controller 414. The zero input response Zi(n) is a response output in dependence only on the internal state of the filter when the filter is operated on the assumption that the signal on the input side of the filter processor 410 is completely zero. The zero state response Zs(n) is a response output when an input is supplied to the filter processor 410 is operated on the assumption that the internal state of the filter is zero.

The gain controller 414 includes a gain calculator 415, gain multiplier 416 and adder 417, a gain to be multiplied by the zero state response Zs(n) from the filter processor 410 is calculated in the gain calculator 415, the gain is multiplied in the gain multiplier 416, and the result of multiplication is added to the zero input response in the adder 417. As a result, an output speech signal So(n) whose power is adjusted is generated and is supplied to a speech signal output terminal 404.

If the gain control method according to this embodiment is used, it becomes possible to make the power of the output speech signal So(n) of the post filter 403 completely equal to the power of the input speech signal S(n) in the unit of preset speech interval (for example, sub-frame). Further, the power of the output speech signal at the boundary between the intervals can be prevented from being discontinuous without effecting the process such as smoothing of the gain. In this embodiment, whether or not the powers can be made equal to each other is determined when the positive gain is used, and if the powers cannot be made equal to each other, the gain is set to a gain value $C_4$ ($\geqq 0$) which gives less influence on a difference in the power on the input side and output side. As a result, the speech quality of the output speech signal So(n) from the post filter 403 can be stably improved.

The gain calculator 415 derives the gain g based on the following equations (33) to (38).

$$\text{IF}(d>0) \tag{33}$$

$$g=[\text{sqrt}(b^2+d)-b]/a \tag{34}$$

else $$g=C_4 \tag{35}$$

endif where $$a=\Sigma Z_s(n)Z_s(n)\ (n=0 \text{ to } N-1) \tag{36}$$

$$b=\Sigma Z_i(n)Z_s(n)\ (n=0 \text{ to } N-1) \tag{37}$$

$$d=a(\Sigma S(n)S(n)-\Sigma Z_i(n)Z_i(n))\ (n=0 \text{ to } N-1) \tag{38}$$

The function sqrt(x) indicates the square root of x, and N indicates the length of a preset speech interval (for example, sub-frame). The parameter $C_4$ is a value used as g in such a bad condition that the powers of the input and output speech signals cannot be made equal to each other by use of a gain which is not negative and it is preferable to set $C_4$ in a range of $0 \leqq C_4 < 1$.For example, it is possible to set $C_4$ to a fixed value, for example, $C_4=0.5$.

When g is derived based on the condition (d>0) expressed by the expression (33), g can be certainly prevented from being set to a negative value so that the gain control can be stably effected. As is clearly understood from the equations (36) and (38), the condition indicates that the power of the zero state response is positive and the power of the input speech signal is larger than the power of the zero input response. If the above condition is not satisfied, the powers on the input and output sides cannot be made equal to each other by use of the positive gain.

The equations (34), (36), (37) and (38) are also indicated in Japanese Patent Application No. 2-41286 (adaptive post filter), but in this method, the conditional expression used for deriving the gain g has a problem. That is, in Japanese Patent Application No. 2-41286, since it is determined that "if the value ($b^2$+d) in the parentheses of sqrt is positive, g is derived according to the equation (34)", the value of g derived by this method may become negative. If the negative gain is used, the waveform obtained after the zero state response Zs(n) is multiplied by the gain is inverted and the finally obtained output speech waveform is disturbed, thereby introducing cracking and offensive noise.

The above problem is explained by using concrete numeric values. If a=2, b=5, d=−24 are derived by the equations (35), (36) and (37), ($b^2+d=5^2-24>0$ in Japanese Patent Application No. 2-41286 and $g=(\text{sqrt}(5^2-24)-5)/2=-2$ in the gain calculating equation (34), and as a result, an attempt is made to forcedly make the powers on the input and output sides equal to each other by modifying the waveform by use of the negative gain.

On the other hand, in this embodiment, since d is negative, the equation (34) is not used according to the condition defined by the expression (33) and the positive gain value $g=C_4$ ($1>C_4\geqq 0$) is used according to the equation (35). Thus, in the gain control in this embodiment, the powers on the input and output sides are not made equal to each other by use of the negative gain, and if the powers cannot be made equal to each other by use of the positive gain, the gain g is replaced by the value $C_4$ which is not negative in order to suppress the influence by the non-coincidence of the powers to almost minimum. As a result, the speech quality of the post filter can be stably improved in comparison with a conventional case.

Figure 14:
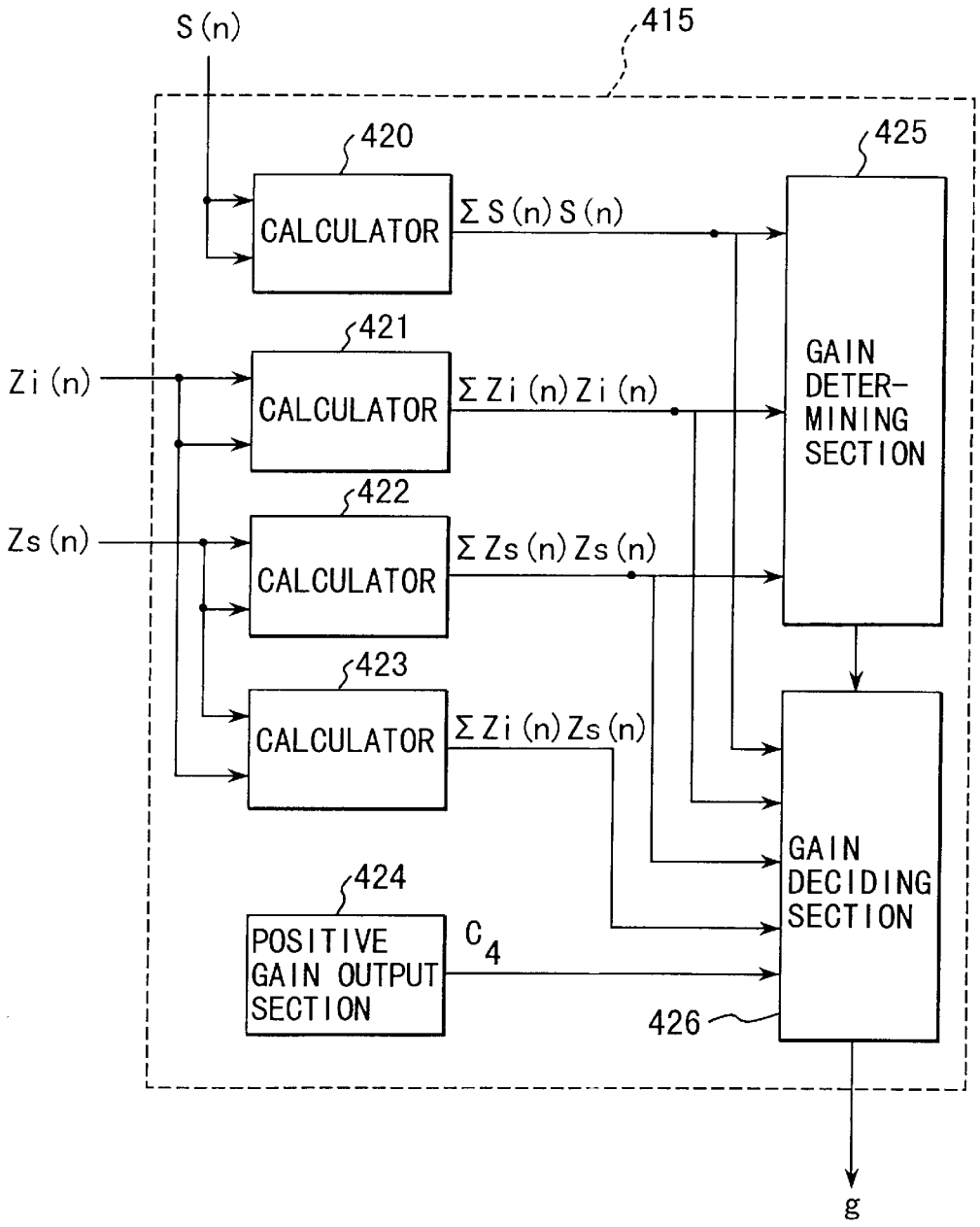
FIG. 14 is a block diagram showing the construction of a gain calculator in FIG. 13.

FIG. 14 shows an example of the signal flow of the more detail process in the gain calculator 415. In FIG. 14, a calculator 420 calculates the power from an input speech signal S(n) (corresponding to the first term in the parentheses on the right side of the equation (38)). A calculator 421 calculates the power of zero input response $Z_i(n)$ (corresponding to the second term in the parentheses on the right side of the equation (38)). A calculator 422 calculates the power of zero state response $Z_s(n)$ (corresponding to a in the equation (36)). A calculator 423 calculates the inner product of the zero input response and zero state response (corresponding to b in the equation (37)). A gain determining section 425 determines the condition corresponding to the expression (33) based on the calculated values (information of parameters a and d) from the calculators 420, 421 and 422. However, the parameter b in the equation (37) is not used for determination. Based on the result of determination, determination information for determining whether the equation (34) or (35) is used for calculation of the gain is supplied to a gain deciding section 426. The gain deciding section 426 receives the calculated values from the calculators 420, 421, 422 and 423 and the positive gain $C_4$ from a positive gain output section 424, decides the gain g according to the equation (34) or (35) based on the determining information from the gain determining section 425, and outputs the thus decided gain as an output of the gain calculator 415.

Referring to FIG. 13 again, the gain multiplier 416 multiplies the gain g derived in the gain calculator 415 by the zero state response $Z_s(n)$ input from the filter processor 410. The adder 417 outputs a signal obtained by adding the output signal of the multiplier 416 to the zero input response $Z_i(n)$ from the filter processor 410 to the output terminal 404 of the post filter as an output speech signal So(n). An output of the gain controller 414, that is, the output So(n) of the post filter can be expressed by the following equation (39).

$$So(n)=Z_i(n)+gZ_s(n)\ (n=0 \text{ to } N-1) \tag{39}$$

Unlike Japanese Patent Application No. 2-41286, in this embodiment, the gain g indicated by the equation (39) is always set to a value equal to or larger than zero. Thus, since inversion of the waveform of $Z_s(n)$ can be stably prevented, a post filter in which the speech quality of So(n) can be stably improved can be provided. Since P values (So(N−P), . . . , So(N−1)) in the last portion of the output speech signal So(n) derived in the equation (39) can be used as the initial internal state of the filter used for calculation of the zero input response in the next speech interval, data 418 indicating the P values in the last portion of the So(n) is supplied to the filter processor 410 as shown in FIG. 13.

Figure 15:
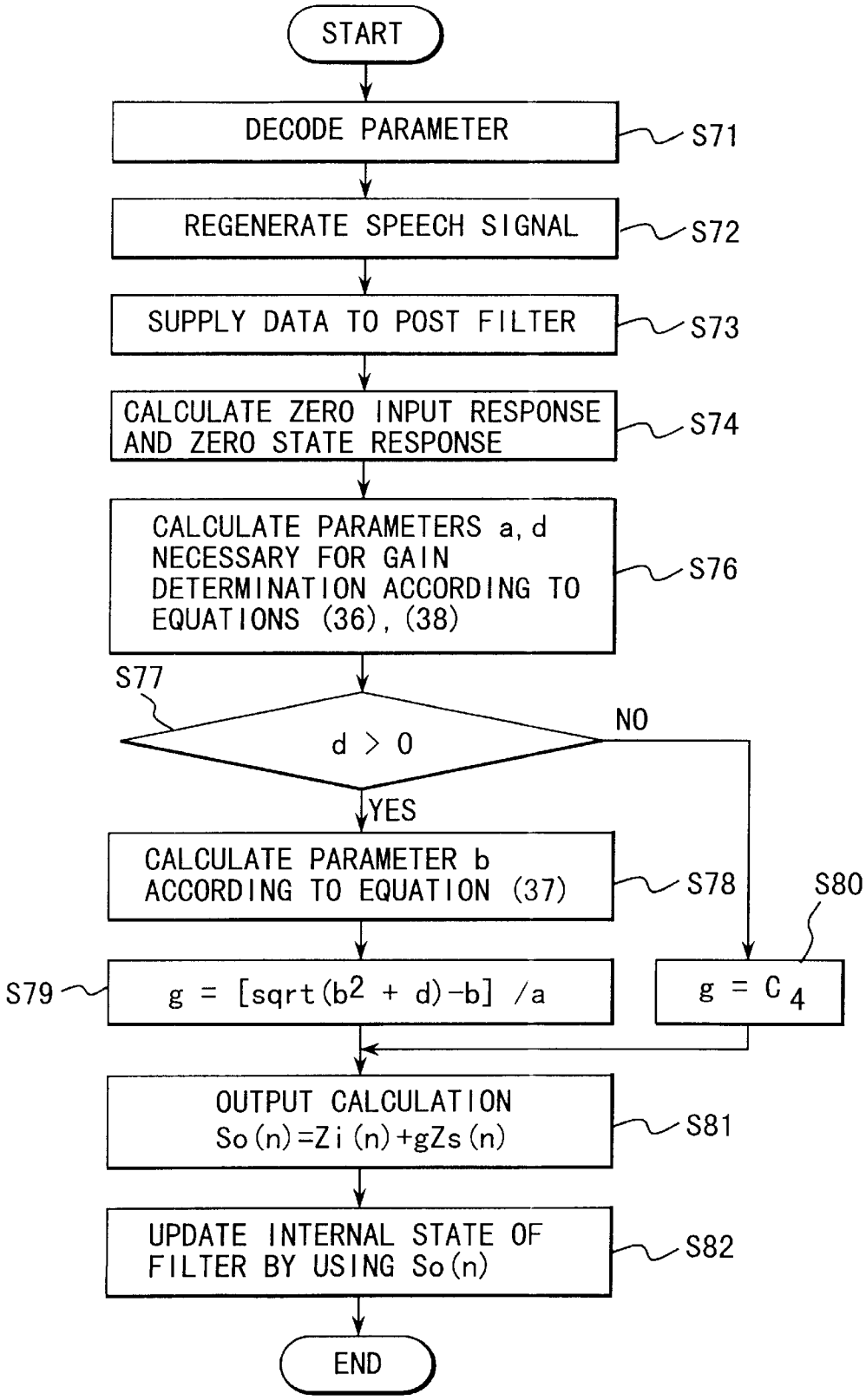
FIG. 15 is a flowchart showing the flow of a process in the post filter according to the sixth embodiment.

Next, the flow of the process effected in one speech interval in this embodiment is explained with reference to the flowchart of FIG. 15.

First, speech compressed information constructed in a parameter form is decoded (step S71), and a speech signal S(n) is reconstructed based on the decoded information (step S72). The speech signal S(n) is input to the post filter and pitch information and LPC coefficients necessary for constructing a filter in the post filter are input to the post filter (step S73). Then, the process in the post filter is started. First, zero input response and zero state response are derived in the filter processor in the post filter 403 (step S74). Next, parameters a and d necessary for determination of the gain are calculated according to the equations (36) and (38) by use of the zero input response, zero state response and input speech signal (step S76). The parameter d of the calculated parameters a and d is subjected to the gain determination of the expression (33) (step S77), and if the condition is satisfied ("YES"), the gain g is derived by use of the equations (37) and (34) (steps S78, S79), and if the condition is not satisfied ("NO"), the gain is set to $g=C_4$ by use of the equation (36) (step S80). An output speech signal So(n) is derived by adding a signal obtained by multiplying the zero state response by g to zero input response (step S81). Finally, the initial internal state of the filter used for zero input response calculation is updated by use of So(n) (step S82).

Thus, according to this embodiment, when the gain to be multiplied by the speech signal is controlled in order to compensate for a variation in the power of the speech signal caused by the filtering process effected for the speech signal to adjust the spectrum shape of the speech signal, the gain to be multiplied by the speech signal is calculated, the sign of the gain is determined, and if the gain is negative, the gain is replaced by a value which is not negative and is given by a preset method, and which is preferably set to 0 or more and less than 1, thereby making it possible to prevent deterioration in the speech quality caused by use of the negative gain.

In this embodiment, the gain control is effected by adjusting the power of the output speech signal So(n) with the power of the input speech signal S(n) of the gain controller used as an index as indicated by the equation (38), but the index used for gain control is not limited to the power of the input speech signal and this invention can be effectively applied when power information derived from the speech signal reconstructor 102, information for setting the gain to different values according to the voiced interval, e.g. voiced frame and the unvoiced interval, e.g. unvoiced frame or other information is used as the index of the gain control, for example.

In the embodiment described above, as the method for compensating for unnecessary spectral tilt caused by the spectrum envelop emphasis filter 112 with transfer function of F(z)=A(z)/B(z), two methods including (1) a method (zero-pole method) for compensating for the spectral tilt caused by the coefficient A(z) on the numerator side by use of the zero filter and compensating for the spectral tilt caused by the coefficient B(z) on the denominator side by use of the pole filter, (2) a method (which is referred to as "pole-zero method" in the description) for compensating for the spectral tilt caused by the coefficient A(z) on the numerator side by use of the pole filter and compensating for the spectral tilt caused by the coefficient B(z) on the denominator side by use of the zero filter are explained, but as a method of combination of the methods (1) and (2), it is considered to use (3) a method (zero-zero method) for compensating for the spectral tilts caused by the coefficient A(z) on the numerator side and the coefficient B(z) on the denominator side by use of an adaptive filter which is a combination of a zero filter and a zero filter and (4) a method (pole-pole method) for compensating for the spectral tilts by use of a combination of a pole filter and a pole filter, but the detail explanation thereof is omitted.

Further, in the above embodiments, the filter coefficients of the adaptive filter 121 and pitch tilt compensation filter 205 are updated together with the filter coefficients of the spectrum envelop emphasis filter 112 and pitch harmonics emphasis filter 204. However, in order to more smoothly update the filter coefficients with time, it is effective to use a method for using, in the current speech interval in the adaptive filter 121 and pitch tilt compensation filter 205, filter coefficients obtained by interpolation by use of filter coefficients which are derived from the filter coefficients of the spectrum envelop emphasis filter 112 and pitch harmonics emphasis filter 204 in the current speech interval and the filter coefficients used in the preceding speech interval in the adaptive filter 121 and pitch tilt compensation filter 205. In this case, since variations in the transfer functions of the adaptive filter 121 and pitch tilt compensation filter 205 become smooth, a phenomenon that the final speech signal will be minutely and repeatedly varied by the background noise can be prevented.

A seventh embodiment will be described, with reference to FIGS. 16 and 17.

The first to sixth embodiments described above are post filters for use in a decoding side. By contrast, the seventh embodiment is a weighting filter for use in a spectrum shape adjusting method, which is to be provided in an encoding side. The weighting filter is designed to compensate for the unnecessary slop of a spectrum.

The weighting filter compensates for a spectral tilt, optimizing the weighting of a distortion criterion which serves as an index for selecting codes. Thus, the filter makes it possible to select codes which faithfully represent original sound. As a result, the quality of sound reconstructed is improved, without increasing the bit rate remains or using a high-efficiency encoding system.

Figure 16:
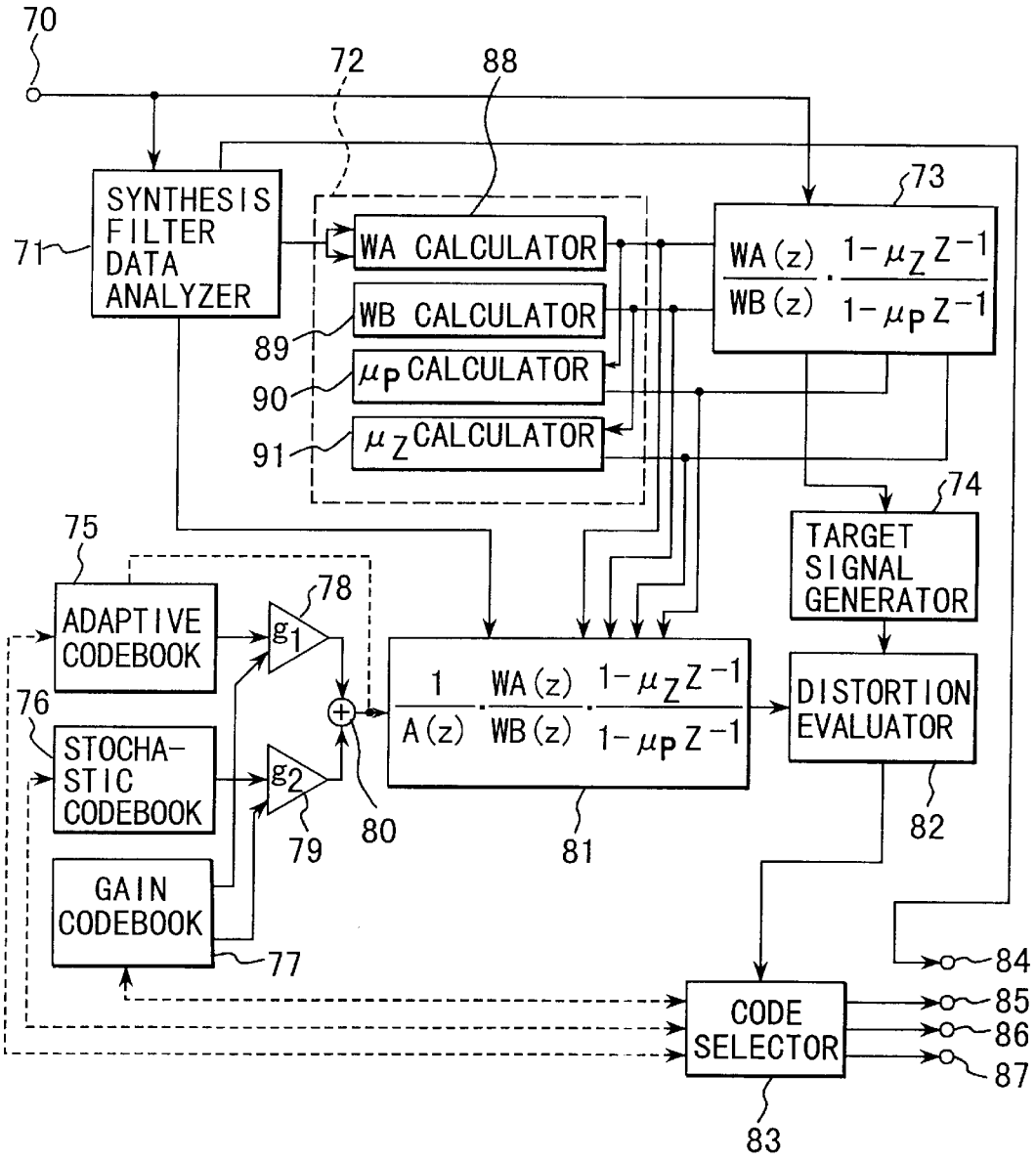
FIG. 16 is a block diagram of a speech encoder of the seventh embodiment according to the present invention.
Figure 17:
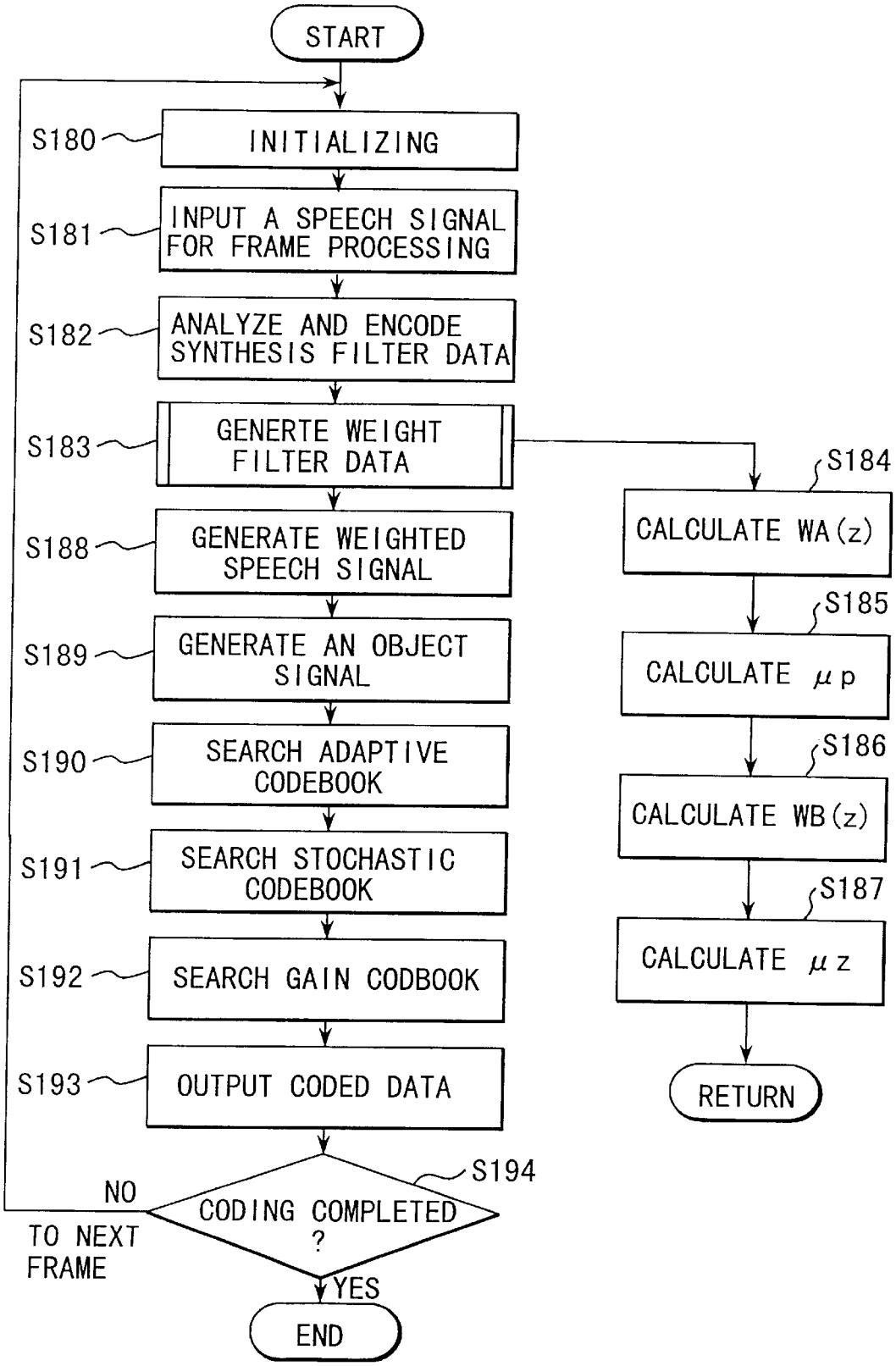
FIG. 17 is a flowchart showing the flow of a process in the speech encoder of FIG. 16.

FIG. 16 is a block diagram of a speech encoder incorporating the weighting filter according to the seventh embodiment. In operation, a speech signal input to the input terminal 70 is analyzed and encoded, frame by frame, into coded speech data. The speech data is output from the output terminals 84 to 87.

More precisely, the data for the synthesis filter and the excitation signal are encoded. The data for the synthesis filter is extracted from the speech signal, in units of frames having a length ranging from about 10 ms to about 30 ms. In practice, the excitation signal is encoded in units of sub-frames much shorter than the frames. For simplicity, however, it is assumed here that the excitation signal is encoded in units of frames, not sub-frames.

As has been indicated, the signal output by the synthesis filter to which the excitation signal is input is a reconstructed speech signal. The speech encoder shown in FIG. 16 will be described in greater detail.

As seen from FIG. 16, the speech encoder comprises a synthesis filter data analyzer 71, a weighting filter data calculator 72, a weighting filter 73 having a filter with transfer function WA(z)/WB(z) and a filter with transfer function $1-\mu_z Z^{-1}/1-\mu_p Z^{-1}$, a target signal generator 74, an adaptive codebook 75, a stochastic codebook 76, a gain codebook 77, gain suppliers 78 and 79, an adder 80, a weighting synthesis filter 81 having a filter with transfer function WA(z)/WB(z) and a filter with transfer function $1-\mu_z Z^{-1}/1-\mu_p Z^{-1}$, a distortion evaluator 82, and a code selector 83. The weighting filter data calculator 72 comprises a WA calculator 88, a WB calculator 89, a $\mu_P$ calculator 90 and a $\mu_Z$ calculator 91.

The speech encoder differs from the conventional speech encoder, in that the characteristic of the weighting filter 73 is compensated on the basis of the data items obtained in the $\mu_P$ calculator 90 and $\mu_Z$ calculator 91. The operation of the speech encoder will be explained.

The synthesis filter data analyzer 71 analyzes the speech signal supplied from the input terminal 70, in units of frames, and extracts synthesis filter parameters from the speech signal. The parameters thus extracted represent the shape of the spectrum envelope of the speech signal. The parameters can be extracted by means of LPC analysis in which LPC coefficients are acquired from a speech signal. The analyzer 71 further converts the synthesis filter parameters to those which can easily be quantized and encodes these parameters into coded synthesis filter data. The synthesis filter data is supplied from the analyzer 71 to the output terminal 84.

The synthesis filter data analyzer 71 also quantizes the synthesis filter parameters, thus generating quantized synthesis filter data. The quantized synthesis filter data is supplied to the weighted synthesis filter 81, while the synthesis filter data not quantized is supplied to the weighting filter data calculator 72. The calculator 72 processes the synthesis filter data not quantized, thereby calculating parameters of the weighting filter data for use in the weighting filter 73 and the weighted synthesis filter 81. Alternatively, the calculator 72 may process the quantized synthesis filter data to obtain the parameters for use in the filters 73 and 81.

The characteristic of the weighting filter 73, or weighting filter W(z), is represented by the following equation:

$$W(z) = \frac{WA(z)}{WB(z)} \quad \frac{1-\mu_z z^{-1}}{1-\mu_p z^{-1}} \tag{40}$$

WA(z)/WB(z) in the equation (40) represents the characteristic of the conventional weighting filter. The conventional weighting filter has an unnecessary spectral tilt. To compensate for the unnecessary spectral tilt, a pole-zero filter $(1-\mu_Z Z^{-1})/(1-\mu_P Z^{-1})$ according to the invention is used in the seventh embodiment. More specifically, a first-order pole-zero filter is utilized. Nonetheless, a pole-zero filter of any other type may be used instead. To reduce the amount of data that must be processed in the weighting filter 73, another weighting filter which has characteristic similar to W(z) represented by the equation (40), may be used. For example, a weighting filter may be used which is designed by applying a time window to the impulse response of the transfer function indicated by the right side of the equation (40), thereby to terminate calculation at a short K+1 sample. This weighting filter also includes the invention's compensation technique for the unnecessary spectral tilt of WA(z)/WB(z), without processing a large amount of data. Its characteristic is given as:

$$W(z)=1+\Sigma \mathrm{Window}(i)w(i)z^{-i} \quad i=1 \text{ to } k \tag{41}$$

where window(i) is the time window and w(i) is the impulse response on the right side of the equation (40). Window(i) can be a rectangular window, a Hamming window, or the like.

In the weighting filter data calculator 72, the WA calculator 88 and the WB calculator 89 calculate WA(z) parameters and WB(z) parameters, respectively, for the weighting filter 73, in the following way.

Using an unquantized LPC coefficient $\alpha_i$ (i=1 to P), where P is the order of LPC analysis, the coefficient $\phi_i$ of the WA(z) parameter and the coefficient $\phi$ of the WB(z) parameter are calculated as follows:

$$\phi_i=(\nu_1)^i\alpha_i \quad (i=1 \text{ to } P) \tag{42}$$

$$\phi_i=(\nu_2)^i\alpha_i \quad (i=1 \text{ to } P) \tag{43}$$

P is about 10 when applied to speech encoding. Therefore:

$$WA(z) = 1 + \sum_{i=1}^{P} \phi_i z^{-i} \tag{44}$$

$$WB(z) = 1 + \sum_{i=1}^{P} \phi_i z^{-i} \tag{45}$$

In the equations (42) and (43), $\nu_1$ and $\nu_2$ are parameters used to adjust the weighting. The values for these parameters are: $0<\nu_2<\nu_1<1$. (This means that the weight-adjusting value used in a pole-zero filter is different from that applied in a post filter.) Representative values for the parameters are:

$\nu_1=0.9$, $\nu_2=0.4$.

The $\mu_p$ calculator 90 calculates the coefficient $\mu_p$ of the pole-filter from the WA(z) parameter supplied from the WA calculator 88, by using the coefficient $\phi_i$ of the WA(z) parameter. (The pole filter compensates for the unnecessary spectral tilt which the WA(z) parameters have.) That is, as in the method employed in the second embodiment, algorithm inverse to the Durbin method is applied, thereby finding a first-order PARCOR coefficient from the coefficient $\phi_i$, and the PARCOR coefficient is used as $\mu_p$ of the pole-filter from the WA(z) parameters.

The $\mu_Z$ calculator 91 calculates the coefficient $\mu_Z$ of a zero filter from the WB(z) parameters supplied from the WB calculator 89. (The zero filter compensates for the unnecessary spectral tilt which the WB(z) parameters have.) That is, as in the method employed in the second embodiment, algorithm inverse to the Durbin method is applied, thereby obtaining a first-order PARCOR coefficient from the coefficient and $\phi_i$, and the PARCOR coefficient is used as the coefficient $\mu_Z$ of the pole-filter from the WA(z) parameters.

The coefficients $\mu_P$ and $\mu_Z$ may modified in order to adjust the weighting more optimally. For example, they are modified as follows:

$$\mu_P \leftarrow Y_P \mu_P \tag{46}$$

$$\mu_z \leftarrow Y_Z \mu_z \tag{47}$$

where $Y_P$ and $Y_Z$ are adjustment coefficients. It is desirable that $|Y_P|<=1$, and $|Y_Z|<=1$.

Another method of adjusting the weighting more optimally is to modify the pole-zero filter in accordance with the WA(z) parameters, the WB(z) parameter or the characteristic of the synthesis filter. For example, the adjustment coefficients may be adaptively changed in accordance with whether the synthesis filter has a high-pass characteristic or a low-pass characteristic.

As seen from FIG. 16, the data obtained by the weighting filter data calculator 72 is supplied to the weighting filter 73 and the weighted synthesis filter 81. The weighting filter 73 applies a weight to the input speech signal in accordance with the data supplied from the weighting filter data calculator 72. The speech signal thus weighted is supplied to the target signal generator 74. The generator 74 eliminates the influence of the encoding of the preceding frame, in accordance with the level of the weighted speech signal, and generates a target signal for use in encoding an excitation signal for the present frame.

Next, the excitation signal is encoded by using the adaptive codebook 75, stochastic codebook 76 and gain codebook 77. The adaptive codebook 75 stores the excitation signals used in the past and provides the pitch-period component of the excitation signal. The pitch-period component is defined by the pitch vector which has been encoded to represent a pitch period. The stochastic codebook 76 represents the stochastic component of the excitation signal on the basis of the stochastic vector which corresponds to a stochastic code. The gain codebook 77 is provided to control the gain of the pitch vector and the gain of the stochastic vector. The gain codebook 77 supplies a gain candidate corresponding to a gain code, to both gain suppliers 78 and 79. The gain supplier 78 adds a gain to the pitch vector, and the gain supplier 79 a gain to the stochastic vector. The gain-added pitch vector and the gain-added stochastic vector are input to the adder 80. The adder 80 adds the input vectors together, generating an excitation-signal candidate. The excitation-signal candidate is passed through the weight synthesis filter 81 and input to the distortion evaluator 82. The distortion evaluator 82 searches the codebooks 75, 76 and 77 for codes which will decrease the distortion between the target signal and the output signal of weighted synthesis filter 81 and evaluates the distortion by applying these codes.

This is the principle of retrieving the excitation signal. To reduce the computation complexity for retrieving the excitation signal, the adaptive codebook 75, the stochastic codebook 76 and the gain codebook 77 are sequentially searched in the order mentioned, in most cases. The three codes representing the excitation signal, i.e., the pitch-period code, stochastic code and gain code retrieved from the adaptive codebook 75, stochastic codebook 76 and gain codebook 77, are output to the output terminals 85, 86 and 87, respectively.

The operation of the speech coding device according to the seventh embodiment will be explained, with reference to the flow chart of FIG. 17.

At first, the encoder is initialized (Step S180). A speech signal is then input to the synthesis filter data analyzer 71, in an amount large enough to be processed frame by frame (Step S181). The analyzer 71 analyzes the speech signal, extracts parameters for the synthesis filter provided for the speech signal and encodes these parameters (Step S182). Further, the analyzer 71 generates weighting filter data for constituting a weighting filter (Step S183). Step S183 consists of four steps S184 to S187. In Step S184, the WA(z) parameters are calculated. In Step S185, $\mu_P$ is calculated by applying the WA(z) parameter. In Step S186, the WB(z) parameters are calculated. In Step sl87, $\mu_Z$ is calculated by applying the WB(z) parameters.

Next, the weighting filter data generated in Step S183 is applied, generating a weighted speech signal (Step S188). The influence of the encoding of the preceding frame is removed in accordance with the level of the weighted speech signal, thereby generating a target signal for use in encoding an excitation signal for the present frame (Step S189). Using the target signal, the adaptive codebook 75 is searched (Step S190), the stochastic codebook 76 is searched (Step S191), and the gain codebook 77 is searched (Step S192), thereby encoding an excitation signal. The weighting filter for the weighted synthesis filter is constituted by applying the weighting filter data generated in Step S183. Finally, the coded data for the present frame, thus obtained, is output.

As mentioned above, $\mu_P$ is obtained from the WA(z) parameters, and $\mu_z$ from the WB(z) parameters. Needless to say, $\mu_P$ is obtained from the WB(z) parameter, and $\mu_z$ from the WA(z) parameter, by the method employed in the first embodiment. Furthermore, it is possible to use a pole-zero filter whose order is equal to or higher than the second and which is of the type used in the third embodiment.

In the above embodiment, the placement order of various filters such as the pitch harmonics emphasis filter, spectrum envelop emphasis filter, adaptive filter, pitch tilt compensation filter can be freely changed and it is only necessary for the filters to be cascade-connected.

Further, in the above embodiments, a case wherein this invention is applied to the final stage of the speech decoder is explained, but this invention can be applied to various speech signals other than the decoded speech signal in the speech coding/decoding system, for example, a synthesis speech signal derived in a speech synthesis apparatus in order to enhance the subjective speech quality.

As described above, according to this invention, when the spectrum shape of the speech signal is adjusted by passing the speech signal through the first filter of pole-zero transfer function expressed by A(z)/B(z) and the second filter for compensating for the characteristic of the first filter, the speech quality of the speech signal such as the decoded speech or synthesis speech can be effectively improved by a small amount of calculations by separately deriving two parameters of the second filter from A(z) and B(z).

Further, according to this invention, by effecting the filtering process by the pole filter and zero filter having different parameters in the second filter, the amount of parameters is increased in comparison with a filter constructed by the conventional first-order zero filter, and therefore, the degree of freedom of representation of the transfer function of the filter is enhanced, thereby making it possible to compensate for the spectral tilt with high flexibility and further improving the speech quality. In this case, if $\mu_p$ is derived from A(z) and $\mu_z$ is derived from B(z), the spectral tilt can be compensated for by use of lower-order filter coefficients.

If weighting factors set in a relation of $C_1<C_3<C_0$ are used, $\mu_p$ is derived from a value obtained by weighting a first autocorrelation coefficient derived from the parameters of A(z) by the weighting factor $C_0$ when the first autocorrelation coefficient is smaller than the threshold value (Th) which is approximately 0 and weighting the first autocorrelation coefficient by the weighting factor $C_1$ when the first autocorrelation coefficient is larger than the threshold value Th, and $\mu_z$ is derived from a value obtained by weighting a second autocorrelation coefficient derived from the parameters of B(z) by the weighting factor $C_3$, the speech in an interval in which the first autocorrelation coefficient is smaller than the threshold value Th is a speech such as a consonant which is strong in the high frequency domain and the speech in an interval in which the first autocorrelation coefficient is larger than the threshold value Th is a speech such as a vowel which is strong in the low frequency domain, and as a result, the second filter can be made to have compensation characteristics respectively suitable for consonants and vowels to further effectively improve the speech quality by selectively using the weighting factor according to the result of comparison between the autocorrelation coefficient and the threshold value Th.

Further, according to this invention, when the gain used for compensating for a variation in the power of the speech signal caused by the filtering process effected for adjusting the spectrum shape of the speech signal is controlled, the sign of the gain to be multiplied by the speech signal is determined, and if the gain is negative, the gain is replaced by a small value which is not negative and is given by a preset method, and which is preferably set to 0 or more and less than 1, thereby making it possible to prevent deterioration in the speech quality caused by use of the negative gain.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for adjusting a spectrum shape of an input speech signal, comprising the steps of:

cascade-connecting a first filter having a first pole-zero transfer function for subjecting said input speech signal to a spectrum envelop emphasis and a second filter having a second pole-zero transfer function for compensating a spectral tilt of the spectrum shape of the input speech signal caused by the first filter;

independently deriving two filter coefficients used in the second filter from the first pole-zero transfer function of said first filter; and compensating the spectral tilt using the derived filter coefficients, wherein the second pole-zero transfer function in a z transform domain comprises at least a first-order pole-zero transfer function expressed by $(1-\mu_z Z^{-1})/(1-\mu_p Z^{-1})$, where $\mu_z$ and $\mu_p$ are filter coefficients whose absolute values are smaller than 1 and which are independent from each other, and said step of deriving the filter coefficients derives said $\mu_z$ from a zero transfer function of the first filter and derives said $\mu_z$ from a pole transfer function of the first filter.

2. The method according to claim 1, wherein said step of deriving the filter coefficients includes a step of extracting pole and zero filter coefficients corresponding to the two filter coefficients from the first filter and inputting the pole and zero filter coefficients to the second filter.

3. The method according to claim 1, further comprising a step of subjecting the input speech signal to pitch emphasis and inputting the pitch-emphasized signal to the first filter to be subjected to the spectrum envelop emphasis by the first filter.

4. The method according to claim 1, wherein said step of deriving the filter coefficients includes a step of using weighting factors set in a relation of C1<C3<C0, deriving said $\mu_p$ from a value obtained by weighting a first autocorrelation coefficient derived from the filter coefficient of the zero transfer function by the weighting factor C0 when the first autocorrelation is smaller than a threshold value which is approximately zero and weighting the first autocorrelation coefficient by the weighting factor C1 when the first autocorrelation coefficient is larger than the threshold value, and deriving said $\mu_z$ from a value obtained by weighting a second autocorrelation coefficient derived from the filter coefficient of the pole transfer function by the weighting factor C3.

5. The method according to claim 1, further comprising a step of determining a gain needed to set a power of a speech signal whose spectral tilt is compensated to equal a power of the input speech signal.

6. The method according to claim 5, wherein said step of determining the gain includes the steps of:

determining a sign of the gain to be multiplied by the speech signal whose spectral tilt is compensated; and replacing the gain by a predetermined positive value if the gain is determined to be negative.

7. The method according to claim 5, wherein said step of determining the gain includes the steps of:

determining a sign of the gain to be multiplied by the speech signal whose spectral tilt is compensated; and replacing the gain by a value greater than or equal to zero and less than one if the gain is determined to be negative.

8. An apparatus for adjusting a spectrum shape of an input speech signal, comprising:

a first filter having a pole-zero transfer function which subjects said input speech signal to a spectrum envelop emphasis; and a second filter which compensates a spectral tilt of the spectrum shape of the input speech signal caused by said first filter, the second filter including:

a calculator which independently derives two filter coefficients from the pole-zero transfer function of said first filter; and a filter section which subjects a speech signal output from said first filter to a filtering process using the derived filter coefficients and which compensates the spectral tilt caused by the first filter, wherein said calculator calculates a first parameter corresponding to a first-order partial autocorrelation coefficient which is approximated to a spectrum envelop of a zero transfer function of said first filter and a second parameter corresponding to a first-order partial autocorrelation coefficient which is approximated to a spectrum envelop of a pole transfer function of said first filter, said calculator inputs the first parameter and the second parameter to said filter section, and said filter section includes a transfer function which uses the first parameter and the second parameter to compensate the spectral tilt caused by the first filter.

9. The apparatus according to claim 8, further comprising a pitch harmonics emphasis filter which subjects the input speech signal to a pitch emphasis and which inputs the pitch-emphasized signal to said first filter to be subjected to the spectrum envelop emphasis by said first filter.

10. The apparatus according to claim 8, further comprising a gain controller which sets a power of a speech signal whose spectral tilt is compensated to equal a power of the input speech signal.

11. An apparatus for adjusting a spectrum shape of an input speech signal, comprising:

a first filter having a pole-zero transfer function which subjects said input speech signal to a spectrum envelop emphasis; and a second filter which compensates a spectral tilt of the spectrum shape of the input speech signal caused by said first filter, the second filter including:

a calculator which independently derives two filter coefficients from the pole-zero transfer function of said first filter; and a filter section which subjects a speech signal output from said first filter to a filtering process using the derived filter coefficients and which compensates said spectral tilt caused by the first filter, wherein said calculator calculates a first parameter corresponding to multiple-order partial autocorrelation coefficients which are approximated to a spectrum envelop of a zero transfer function of said first filter and a second parameter corresponding to multiple-order partial autocorrelation coefficients which are approximated to a spectrum envelop of a pole transfer function of said first filter, said calculator inputs the first parameter and the second parameter to said filter section, and said filter section includes a transfer function which uses the first parameter and the second parameter to compensate the spectral tilt caused by said first filter.

12. An apparatus for adjusting a spectrum shape of an input speech signal, comprising:

a synthesis filter which analyzes said input speech signal to output synthesis filter data;

a calculator which calculates weighting filter data and a pole-zero transfer function using the synthesis filter data output from the synthesis filter; and a weighting filter which filters the input speech signal using the calculated weighting filter data and the calculated pole-zero transfer function, the weighting filter including a first filter having a first pole-zero transfer function and a second filter having a second pole-zero transfer function, said second filter compensates a spectral tilt of the spectrum shape of the input speech signal caused by the first filter, wherein the second filter has a function of a first-order zero filter having a z domain transfer function expressed by $1-\mu_z Z^{-1}$ and a function of a first-order pole filter having a z domain transfer function expressed by $1/(1-\mu_p z^{-1})$, where an absolute value of $\mu_p$ is smaller than 1.

13. The apparatus according to claim 12, wherein the weighting filter derives parameters of the second filter from the pole-zero transfer function of the first filter individually and sets a characteristic of the second filter by combining the parameters thereof.

14. An apparatus for adjusting a spectrum shape of an input speech signal, comprising:

a first filter having a pole-zero transfer function represented by transfer functions A(z)/B(z);

a second filter cascade-connected to the first filter and having a first parameter and a second parameter, said second filter compensates characteristics of said first filter; and parameter deriving means for individually deriving the first parameter and the second parameter from the transfer functions A(z) and B(z), wherein the parameter deriving means includes a first parameter output section for predicting characteristics of at least one of 1) the transfer function A(z) and 2) an inverse transfer function 1/A(z) to derive a first predictive coefficient and to output the first predictive coefficient as the first parameter; and a second parameter output section for predicting characteristics of at least one of 1) the transfer function B(z) and 2) an inverse transfer function 1/B(z) to derive a second predictive coefficient and to output the second predictive coefficient as the second parameter.

15. A method for adjusting a spectrum shape of an input speech signal, comprising the steps of:

preparing a first filter having a pole-zero transfer function represented by A(z)/B(z) and a second filter for compensating characteristics of the first filter, the second filter having a first-order transfer function represented by $(1-\mu_z Z^{-1})/(1-\mu_p Z^{-1})$, where $\mu_z$ and $\mu_p$ are respective filter coefficients whose absolute values are smaller than 1; and filtering the speech signal by means of the first and second filters.

16. The method according to claim 15, wherein the step of deriving includes a step of deriving $\mu_p$ from the transfer function A(z) and $\mu_z$ from the transfer function B(z).

17. The method according to claim 16, wherein said step of deriving includes a step of using weighting factors set in a relation of C1<C3<C0, deriving said $\mu_p$ from a value obtained by weighting a first autocorrelation coefficient derived from a filter coefficient of the transfer function A(z) by the weighting factor C0 when the first autocorrelation coefficient is smaller than a threshold value which is approximately zero and weighting the first autocorrelation coefficient by the weighting factor C1 when the first autocorrelation coefficient is larger than the threshold value, and deriving said $\mu_z$ from a value obtained by weighting a second autocorrelation coefficient derived from a filter coefficient of the transfer function B(z) by the weighting factor C3.

18. The method according to claim 15, further comprising the steps of:

determining a gain needed to set a power of a speech signal whose spectral tilt is compensated to equal a power of the input speech signal;

determining the sign of the gain to be multiplied by the speech signal whose spectral tilt is compensated; and replacing the gain by a predetermined positive value if the gain is determined to be negative.

19. The method according to claim 15, further comprising the steps of:

determining a gain needed to set a power of a speech signal whose spectral tilt is compensated to equal a power of the input speech signal;

determining the sign of the gain to be multiplied by the speech signal whose spectral tilt is compensated; and replacing the gain by a predetermined value which is greater than or equal to zero and less than one if the gain is determined to be negative.

20. A method for adjusting a spectrum shape of an input speech signal, comprising the steps of:

preparing a first filter having a pole-zero transfer function represented by transfer functions A(z)/B(z) and a second filter for compensating characteristics of the first filter, the second filter having a first-order transfer function represented by $(1-\mu_z Z^{-1})/(1-\mu_p Z^{-1})$, where $\mu_z$ and $\mu_p$ are respective filter coefficients whose absolute values are smaller than 1;

deriving two parameters used in the second filter from the transfer functions A(z) and B(z) individually; and filtering the speech signal by means of the first and second filters.

21. The method according to claim 20, further comprising the steps of:

determining a gain needed to set a power of a speech signal whose spectral tilt is compensated to equal a power of the input speech signal;

determining the sign of the gain to be multiplied by the speech signal whose spectral tilt is compensated; and replacing the gain by a predetermined positive value if the gain is determined to be negative.

22. The method according to claim 20, further comprising the steps of:

determining a gain needed to set a power of a speech signal whose spectral tilt is compensated to equal a power of the input speech signal;

determining the sign of the gain to be multiplied by the speech signal whose spectral tilt is compensated; and replacing the gain by a predetermined value which is greater than or equal to zero and less than one if the gain is determined to be negative.

* * * * *